US012320203B2

(12) United States Patent
Roberts et al.

(10) Patent No.: US 12,320,203 B2
(45) Date of Patent: Jun. 3, 2025

(54) ELECTRICAL CONTACT FOR PERFORATING GUN ASSEMBLY

(71) Applicant: Halliburton Energy Services, Inc., Houston, TX (US)

(72) Inventors: Courtney Ann Thain Roberts, Alvarado, TX (US); Kevin Cook, Alvarado, TX (US); Cynthia Anne Kane, Alvarado, TX (US); Wesley N. Ludwig, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/501,730

(22) Filed: Nov. 3, 2023

(65) Prior Publication Data

US 2024/0209694 A1 Jun. 27, 2024

Related U.S. Application Data

(60) Provisional application No. 63/434,421, filed on Dec. 21, 2022.

(51) Int. Cl.

| | |
|---|---|
| ***E21B 17/02*** | (2006.01) |
| ***E21B 43/1185*** | (2006.01) |
| ***F42B 3/103*** | (2006.01) |
| ***F42B 3/198*** | (2006.01) |

(52) U.S. Cl.

CPC ..... *E21B 17/028* (2013.01); *E21B 43/1185* (2013.01); *F42B 3/103* (2013.01); *F42B 3/198* (2013.01)

(58) Field of Classification Search

CPC ..... E21B 43/1185; F42D 1/045; F42D 1/043; F42D 1/04; H01R 13/2428

See application file for complete search history.

(56) References Cited

U.S. PATENT DOCUMENTS

| | | | |
|---|---|---|---|
| 4,539,909 | A | 9/1985 | Day et al. |
| 4,703,986 | A | 11/1987 | McCormick |
| 4,718,345 | A | 1/1988 | Yunan |

(Continued)

FOREIGN PATENT DOCUMENTS

| | | | |
|---|---|---|---|
| DE | 102021108869 | A1 | 11/2021 |
| WO | 2016118179 | A1 | 7/2016 |

(Continued)

OTHER PUBLICATIONS

International Search Report and Written Opinion for International Patent Application No. PCT/US2023/083902 dated Apr. 18, 2024. PDF file. 10 pages.

(Continued)

*Primary Examiner* — Tara Schimpf
*Assistant Examiner* — Lamia Quaim
(74) *Attorney, Agent, or Firm* — John Wustenberg; C. Tumey Law Group PLLC

(57) ABSTRACT

In general, in one aspect, embodiments relate to an electrical contact that includes a contact plate, a support plate, and three or more bends disposed between the contact plate and the support plate to counteract a force applied to the contact plate when engaged by a contact pin, where the electrical contact is configured to convey a detonating signal through an electrical feedthrough extending through at least a bulkhead of two or more perforating guns.

17 Claims, 14 Drawing Sheets

(56) References Cited

U.S. PATENT DOCUMENTS

| | | | | |
|---|---|---|---|---|
| 4,778,404 | A | 10/1988 | Pass | |
| 5,201,598 | A | 4/1993 | Tehan | |
| 6,059,595 | A | 5/2000 | Lacrouts-Cazenave | |
| 6,112,813 | A | 9/2000 | Head | |
| 6,783,405 | B1 * | 8/2004 | Yen | H01R 12/58 439/700 |
| 7,121,340 | B2 | 10/2006 | Grove et al. | |
| 7,197,985 | B2 | 4/2007 | Markel et al. | |
| 8,286,697 | B2 | 10/2012 | Evans et al. | |
| 8,347,963 | B2 | 1/2013 | Johnson et al. | |
| 8,555,764 | B2 | 10/2013 | Le et al. | |
| 8,939,802 | B2 | 1/2015 | Hara et al. | |
| 8,978,749 | B2 | 3/2015 | Rodgers et al. | |
| 9,523,265 | B2 | 12/2016 | Upchurch et al. | |
| 9,605,937 | B2 | 3/2017 | Eitschberger et al. | |
| 10,507,433 | B2 | 12/2019 | Eitschberger et al. | |
| 10,669,821 | B2 | 6/2020 | Knight et al. | |
| 11,078,761 | B2 | 8/2021 | Grove et al. | |
| 11,098,563 | B1 | 8/2021 | Ludwig | |
| 11,299,967 | B2 | 4/2022 | Bradley et al. | |
| 11,313,208 | B2 | 4/2022 | Hoelscher et al. | |
| 11,359,468 | B2 | 6/2022 | Roberts et al. | |
| 11,547,976 | B2 | 1/2023 | Ledwon et al. | |
| 11,560,778 | B2 | 1/2023 | Grove et al. | |
| 11,608,720 | B2 | 3/2023 | Preiss et al. | |
| 11,674,370 | B2 | 6/2023 | Shelton et al. | |
| 2003/0047313 | A1 | 3/2003 | Wehunt, Jr. | |
| 2004/0216633 | A1 | 11/2004 | Kash | |
| 2004/0216866 | A1 | 11/2004 | Barlow et al. | |
| 2007/0084336 | A1 | 4/2007 | Neves | |
| 2007/0107589 | A1 | 5/2007 | Rospek et al. | |
| 2007/0119327 | A1 | 5/2007 | Myers, Jr. et al. | |
| 2010/0227514 | A1 * | 9/2010 | Rikimaru | G01R 1/06722 439/816 |
| 2011/0042089 | A1 | 2/2011 | Chang et al. | |
| 2014/0260591 | A1 | 9/2014 | Rodgers et al. | |
| 2016/0376879 | A1 | 12/2016 | Goodman et al. | |
| 2017/0145798 | A1 | 5/2017 | Robey et al. | |
| 2017/0275974 | A1 | 9/2017 | Von Kaenel et al. | |
| 2018/0112500 | A1 | 4/2018 | Collins et al. | |
| 2018/0195372 | A1 | 7/2018 | Robey et al. | |
| 2020/0024935 | A1 | 1/2020 | Eitschberger et al. | |
| 2020/0048996 | A1 | 2/2020 | Anthony et al. | |
| 2020/0200516 | A1 | 6/2020 | Zemla et al. | |
| 2020/0248535 | A1 | 8/2020 | Goyeneche | |
| 2020/0256166 | A1 | 8/2020 | Knight et al. | |
| 2020/0392819 | A1 | 12/2020 | Robey et al. | |
| 2021/0172298 | A1 | 6/2021 | Knight et al. | |
| 2021/0189846 | A1 * | 6/2021 | Bradley | E21B 43/117 |
| 2021/0222525 | A1 | 7/2021 | Dyess et al. | |
| 2021/0277752 | A1 | 9/2021 | Eitschberger | |
| 2021/0332678 | A1 | 10/2021 | Anthony et al. | |
| 2021/0396103 | A1 * | 12/2021 | MacGillivray | E21B 43/11855 |
| 2022/0010660 | A1 | 1/2022 | Dyess et al. | |
| 2022/0018226 | A1 | 1/2022 | Wells et al. | |
| 2022/0018227 | A1 | 1/2022 | Kash et al. | |
| 2022/0099423 | A1 | 3/2022 | Sullivan et al. | |
| 2022/0127935 | A1 | 4/2022 | Grove et al. | |
| 2022/0145732 | A1 | 5/2022 | Anthony et al. | |
| 2022/0282600 | A1 | 9/2022 | Dyess et al. | |
| 2023/0069950 | A1 | 3/2023 | Badii et al. | |
| 2023/0184066 | A1 | 6/2023 | Hoelscher et al. | |

FOREIGN PATENT DOCUMENTS

| | | | |
|---|---|---|---|
| WO | 2021198145 | A1 | 10/2021 |
| WO | 2022184731 | A1 | 9/2022 |

OTHER PUBLICATIONS

Halliburton. Velocity™ Perforating System Plug and Play Guns For Pumpdown Operations. Halliburton, 2021. H012844WP Mar. 2021. PDF file. 8 pages.

Halliburton. Velocity™ Perforating System Improved Surface Efficiency and Downhole Reliability. Halliburton, 2017. H012737 Dec. 2017. PDF file. 1 page.

Halliburton. Velocity™ Aligned Gun System. Halliburton, 2023. H014094 Feb. 2023. PDF file. 2 pages.

Halliburton. Velocity™ Revolve Gun System. Halliburton, 2023. H014095 Feb. 2023. PDF file. 2 pages.

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

* cited by examiner

ELECTRICAL CONTACT FOR PERFORATING GUN ASSEMBLY

CROSS REFERENCE TO RELATED APPLICATIONS

The present application is a non-provisional application of provisional U.S. Patent Application No. 63/434,421 filed Dec. 21, 2022, the entire disclosure of which is incorporated herein by reference.

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises large diameter metal tubulars that are connected end-to-end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing is perforated to allow the formation fluids to enter the wellbore. These perforations are hydraulic openings that extend through the casing and into the surrounding formation.

Typically, perforations are created by lowering a perforating gun string downhole and detonating a series of explosive shaped charges adjacent to the production zone. For safety, perforating guns may be transported to a wellsite in a partially unassembled state to prevent accidental detonation. Once fully assembled at the wellsite, a perforating gun string may be lowered into the cased wellbore on an appropriate conveyance, such as a wireline. An explosive train is then initiated to detonate the shaped charges in a predetermined, serial fashion. The perforating gun string may then be retrieved to the surface. Common problems associated with these perforating gun strings may include, for example, occasional detonation failure after lowering the perforating gun string to its target depth.

BRIEF DESCRIPTION OF THE DRAWINGS

These drawings illustrate certain aspects of some of the embodiments of the present disclosure and should not be used to limit or define the method.

DETAILED DESCRIPTION

The disclosure is directed to a perforating tool assembly used during perforation of wellbore casings for hydrocarbon recovery, and more particularly, this disclosure relates to an electrical contact of the perforating tool assembly. The present disclosure may address reliability issues. Specifically, the features disclosed herein may address the problem of occasional detonation failure.

Figure 1:
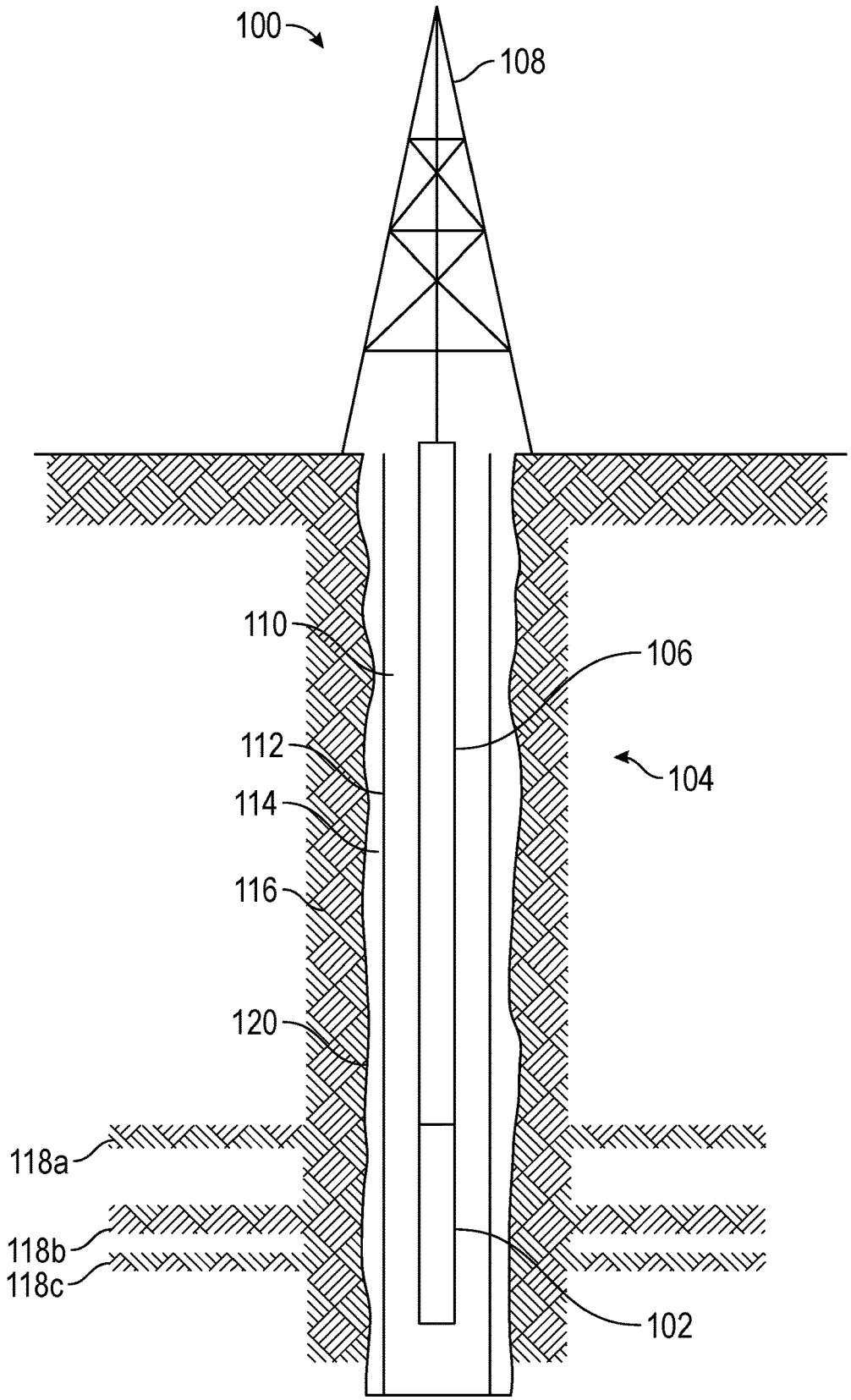
FIG. 1 is a system showing a perforating gun in a wellbore during a land-based operation, in accordance with some examples of the present disclosure.

FIG. 1 is a system 100 showing a perforating tool assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, i.e., "borehole", extending any appropriate distance into subterranean formation 116. In one or more examples, one or more regions of the wellbore 110 may be secured at least in part by cement 114.

Servicing rig 108 may be a drilling rig, completion rig, workover rig, or other mast structure supporting work string 104. In some examples, servicing rig 108 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

As illustrated, work string 104 may comprise a conveyance 106 and a perforating tool assembly 102, i.e., "perforating gun string," "gun string," or "gun assembly," comprising one or more perforating guns. In addition, work string 104 may comprise other downhole tools, such as one or more packers, one or more completion components, e.g., screens and/or production valves, one or more sensing components and/or measuring equipment, i.e., downhole sensors, and other equipment not shown in FIG. 1. In operation, work string 104 is lowered into wellbore 110 and one or more explosive charges disposed within the one or more perforating guns are detonated to perforate casing 112 to facilitate fluid communication between one or more production zones ("pay zones") 118*a*, 118*b*, 118*c*, etc., and wellbore 110.

As will be shown in later figures, e.g., FIGS. 3B, perforating tool assembly 102 may comprise a single or a plurality of perforating guns, which may be coupled together on a single gun string. Each perforating gun of the perforating tool assembly 102 comprises a charge tube assembly. While the present figures generally show a single, or a few perforating guns, it should be understood that perforating tool assembly 102 may comprise any suitable number of perforating guns. In one or more examples, the perforating tool assembly 102 may further comprise a firing head for initiating a detonation train to fire each of the perforating guns. In addition, the perforating tool assembly 102 may further comprise tandems, spacers, or other coupling structures for coupling together the perforating guns.

Figure 2:
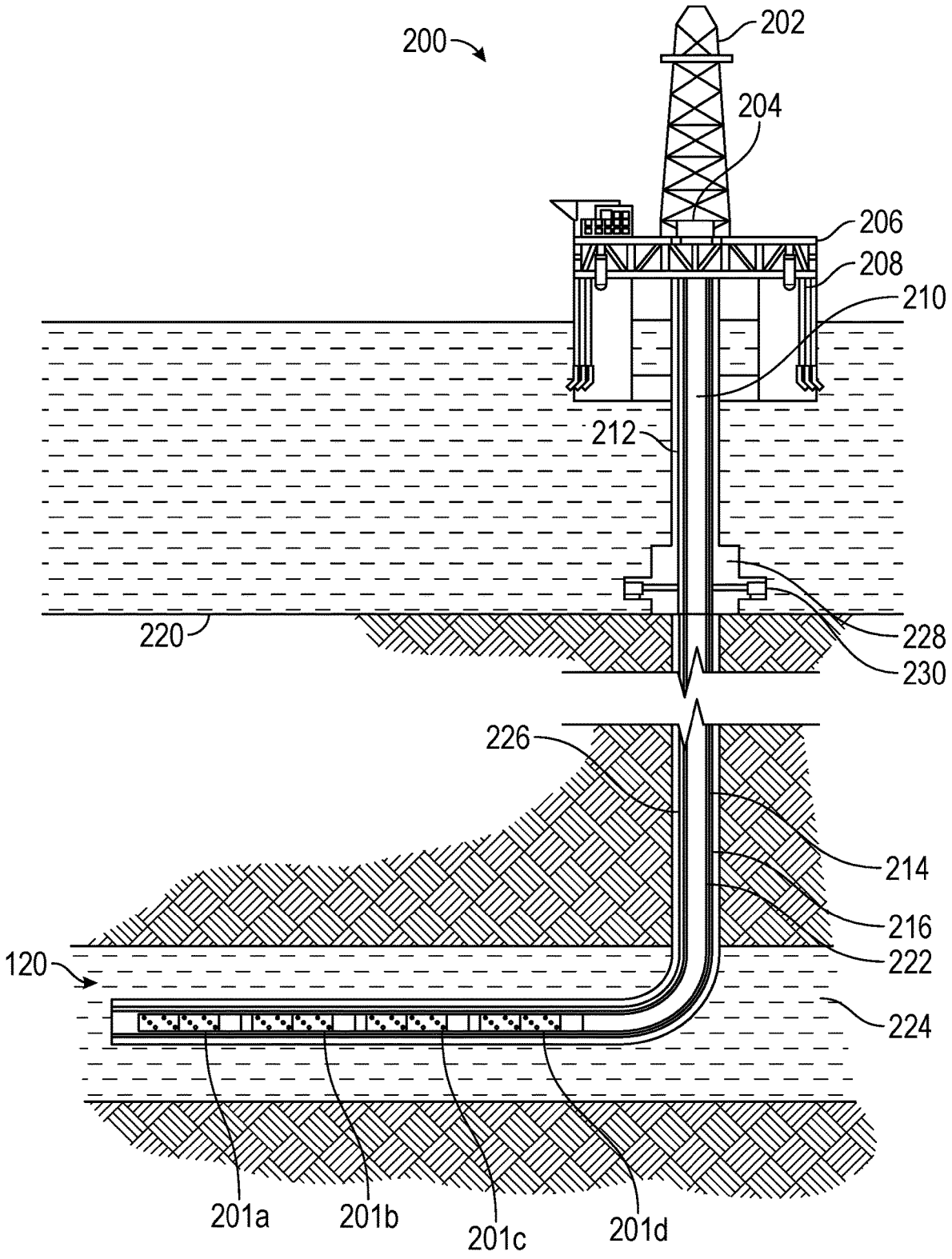
FIG. 2 is a system showing a perforating gun in a wellbore during a sea-based operation, in accordance with some examples of the present disclosure.

FIG. 2 is a system 200 showing one or more perforating guns 201*a*, 201*b*, 201*c*, and 201*d* in a wellbore 214 during a sea-based operation, in accordance with some examples of the present disclosure. As mentioned, the principles shown and described with respect to perforating during land-based operations are equally applicable to sea-based operations.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 202 for raising and lowering tubular strings such as work string 210.

Figure 3A:
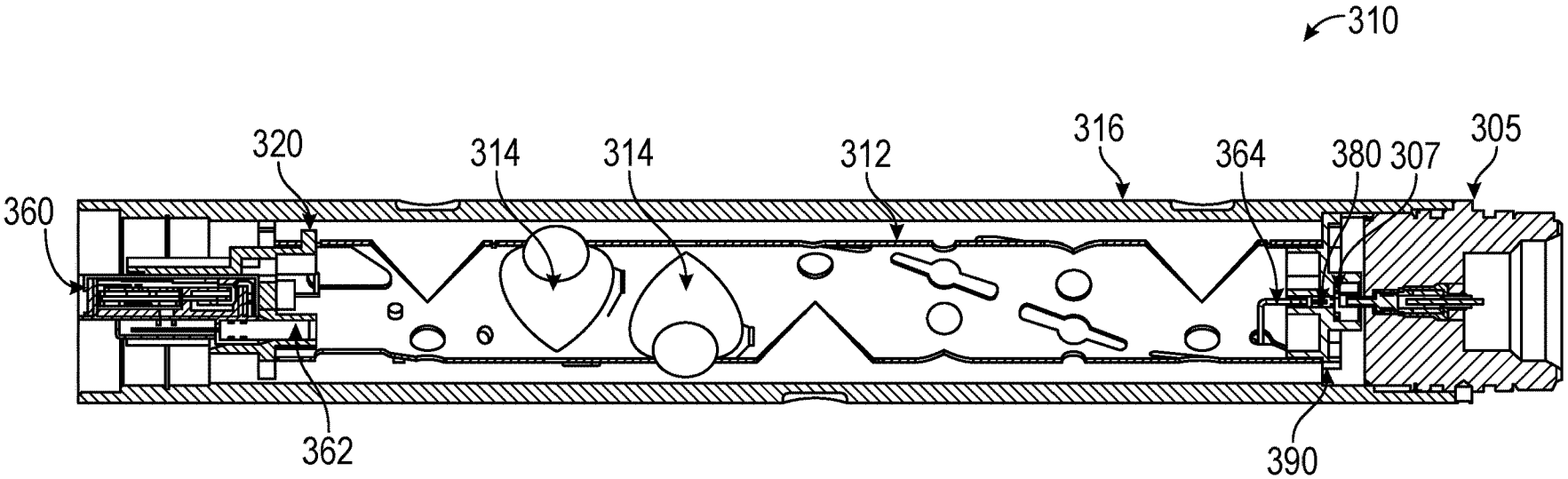
FIG. 3A is a single perforating gun in accordance with some examples of the present disclosure.

A wellbore 214 extends through various earth strata including subterranean formation 224. Casing 226 is cemented within wellbore 214 by cement 216, as with FIG. 1. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 201*a*, 201*b*, 201*c*, and 201*d* which may be joined together during, for example, tubular make-up of the gun string. FIGS. 3A and 3B further show, with more detail, the individual perforating gun(s) 310.

FIG. 3A is a side view of a single perforating gun 310 in accordance with some examples of the present disclosure. The perforating gun 310 may be one of a plurality of perforating guns connected end-to-end to achieve a perforating gun string (e.g., perforating tool assembly 102 on FIG. 1). As illustrated, perforating gun 310 generally comprises: a bulkhead assembly comprising a bulkhead 305; a gun body 316; and a charge tube assembly comprising a charge tube 312, detonator housing 320, and an end alignment 390.

The charge tube 312 has a generally continuous tubular construction in this example. However, all other suitable charge tube configurations are also within the scope of this disclosure, such as modular charge tubes formed by snapping together or otherwise interconnecting any number of charge tube segments that each hold one or more perforating charges within a perforating gun. The charge comprises a plurality of charge casings positioned at different positions and firing orientations along the charge tube 312, for example, within the wedged cut-out sections 314. The wedged cut-out sections 314 of the charge tube 312 provide space for charge casings which hold perforating charges (e.g., shaped charges) and metal liners.

A detonator housing 320 according to this disclosure is coupled to the charge tube 312 at one end. The detonator housing 320 includes various features facilitating assembly including for securing a detonator, detonating cord, and other components, as further discussed below, and illustrated in subsequent figures. One purpose of the detonator housing 320 is to safely house the detonator such that it is protected from external influences (e.g., wellbore 110 of FIG. 1, build-up of static charge, etc.).

The end alignment 390 is also coupled to the charge tube 312 at the other end opposite the detonator housing. The end alignment aligns the charge tube 312 within the gun body 316. As will be shown in subsequent figures, one or more (e.g., three, four, five, or more) radial protrusions (e.g., ears 610*a*, 610*b*, 610*c* of FIG. 6A, 6B) may jut out from an inner tubular body of the end alignment 390. These radial protrusions serve to reduce the amount of material of, i.e., skeletonize, the end alignment 390 by not requiring that the whole outer circumference of the end alignment 390 be filled with the material. In addition, the end alignment 390 may comprise one or more alignment features (e.g., mating notch 612 of FIG. 6C) which may also be disposed on one or more of the radial protrusions to facilitate appropriate alignment of the end alignment 390 within the perforating gun 310 when it interfaces with the charge tube 312 and/or bulkhead 305. Specifically, one or more matching slots (not shown) or other corresponding alignment feature (e.g., protrusion(s)) may be machined or designed within the gun body 316 or other component of the perforating gun 310 such that a mating notch 612 slides into place by an assembler when the end alignment 390 is installed within the gun body 316. This/these alignment feature(s) may also serve to circumferentially stabilize the end alignment within the perforating gun 310 so as to prevent differential drift, i.e., rotation, of the end alignment 390 during or after assembly, which may ensure that the wires are not unnecessarily twisted or that the charge tube 312 is not improperly aligned, all the while reducing or preventing the need for additional fasteners. (This is also one function of collet 602, as will be made clear by FIG. 6F-6H). The end alignment 390 also comprises an electrical passthrough 307 to house one or more electrical connections.

The bulkhead 305 provides stability and structure to the perforating gun 310 as well as an interface to connect to a neighboring perforating gun. The bulkhead 305 generally comprises a body, an electrical feedthrough to house one or more electrical connections, and a receptacle to hold a contact pin (e.g., contact pin of FIG. 5B).

The gun body 316 is the outer tubular body of the perforating gun 310 which houses all the main components of the perforating gun 310 including the charge tube 312, detonator housing 320, end alignment 390, and at least a portion of the bulkhead 305.

Use in the manner described herein may remove or reduce the need for external fasteners, which further increases productivity at the work site by making it easier for an assembler to assemble the perforating gun 310 and/or tubular gun string. For example, one or more sections of (e.g., the end alignment 390, bulkhead 305, detonator housing 320, charge tube 312, gun body 316, or any tubular components of) the perforating gun 310 may, in some examples, be free or essentially free of external fasteners.

As used herein, a "shipping assembly" comprises an at least partially assembled perforating gun which includes at least a gun body 316, a charge tube 312, and end alignment 390, and a bulkhead 305. A shipping assembly would generally not comprise more than a single bulkhead 305, as coupling of multiple perforating guns (e.g., 310*a*, 310*b* of FIG. 3B) would be achieved on-site during tubular make-up of the gun string (e.g., perforating tool assembly 102 of FIG. 3B). A shipping assembly may also comprise a detonator housing 320, however, installation of the detonator within the detonator housing 320 and perforating charges within the charge tube 312 of the perforating gun 310 would be generally performed on site to eliminate the risk of premature activation and accidental detonation of the perforating gun 310 prior to a perforating operation.

Figure 3B:
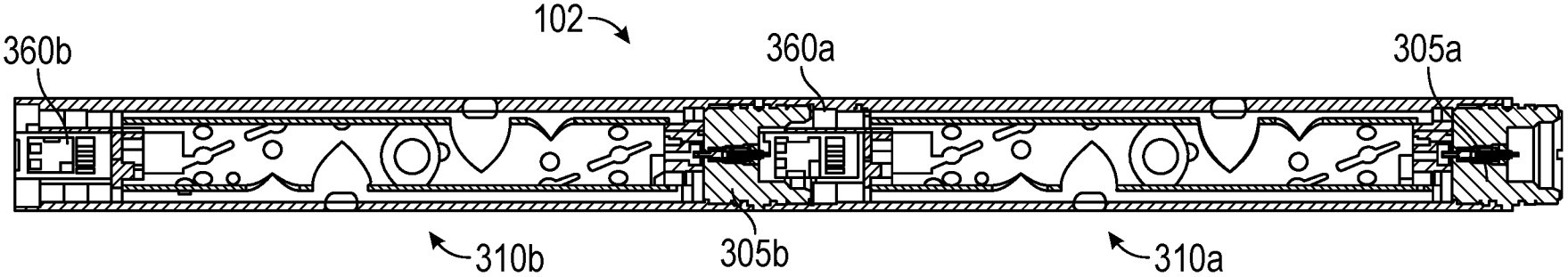
FIG. 3B shows a tubular string with two perforating guns coupled together, in accordance with some examples of the present disclosure.

FIG. 3B shows a perforating tool assembly 102 with two perforating guns 310*a* and 310*b* coupled together, in accordance with some examples of the present disclosure. A first perforating gun 310*a* may be coupled to a second perforating gun 310*b* end-to-end, as illustrated. In the illustrated example, the first perforating gun 310*a* is uphole from the second perforating gun 310*b*.

In one or more examples, a detonation signal is transmitted during operation along the perforating tool assembly 102 in a down-going fashion. For example, the detonation signal may proceed from gun to gun, arriving first at the detonator 360*a* before passing through an electrical feedthrough (e.g., electrical feedthrough 306 of FIG. 3B) of the bulkhead 305*b* of the second (downhole) perforating gun 310*b*. Detonation may occur in a generally down-going fashion following the detonation signal, with the detonation of the second perforating gun 310*b* following detonation of the first perforating gun 310*a*. However, in alternative examples, detonating of the various perforating charges of each individual perforating gun 310*a*, 310*b*, etc., may occur in an up-going direction. This may ensure that the detonation signal always proceeds to the next (downhole) perforating gun in a perforating tool assembly 102. For example, this exemplary configuration prevents scenarios in which a detonation signal is outpaced by the actual detonation of the detonation train, which would result in only a partial detonation of the perforating tool assembly 102. In other words, the risk of detonation failure may be reduced by positioning detonator 360*a* of the first perforating gun 310*a* at the lower end of the gun, e.g., at least partially disposed within the bulkhead 305*b* of the second perforating gun 310*b*, as illustrated.

As mentioned, at least a portion of detonator housing 320*a* corresponding to the first perforating gun 310*a* may be disposed within a bulkhead 305*b* corresponding to the second perforating gun 310*b*. Coupling of a first perforating gun 310*a* to a second perforating gun 310*b* in this manner allows for reliable transmission of a detonation signal (e.g., from an initial firing signal) to propagate along one or more signal conductors (e.g., wires 346*a*, 346*b* in FIG. 3C) traversing the length of the perforating tool assembly 102, thus allowing serial detonation of each perforating gun of the perforating tool assembly 102.

Figure 3C:
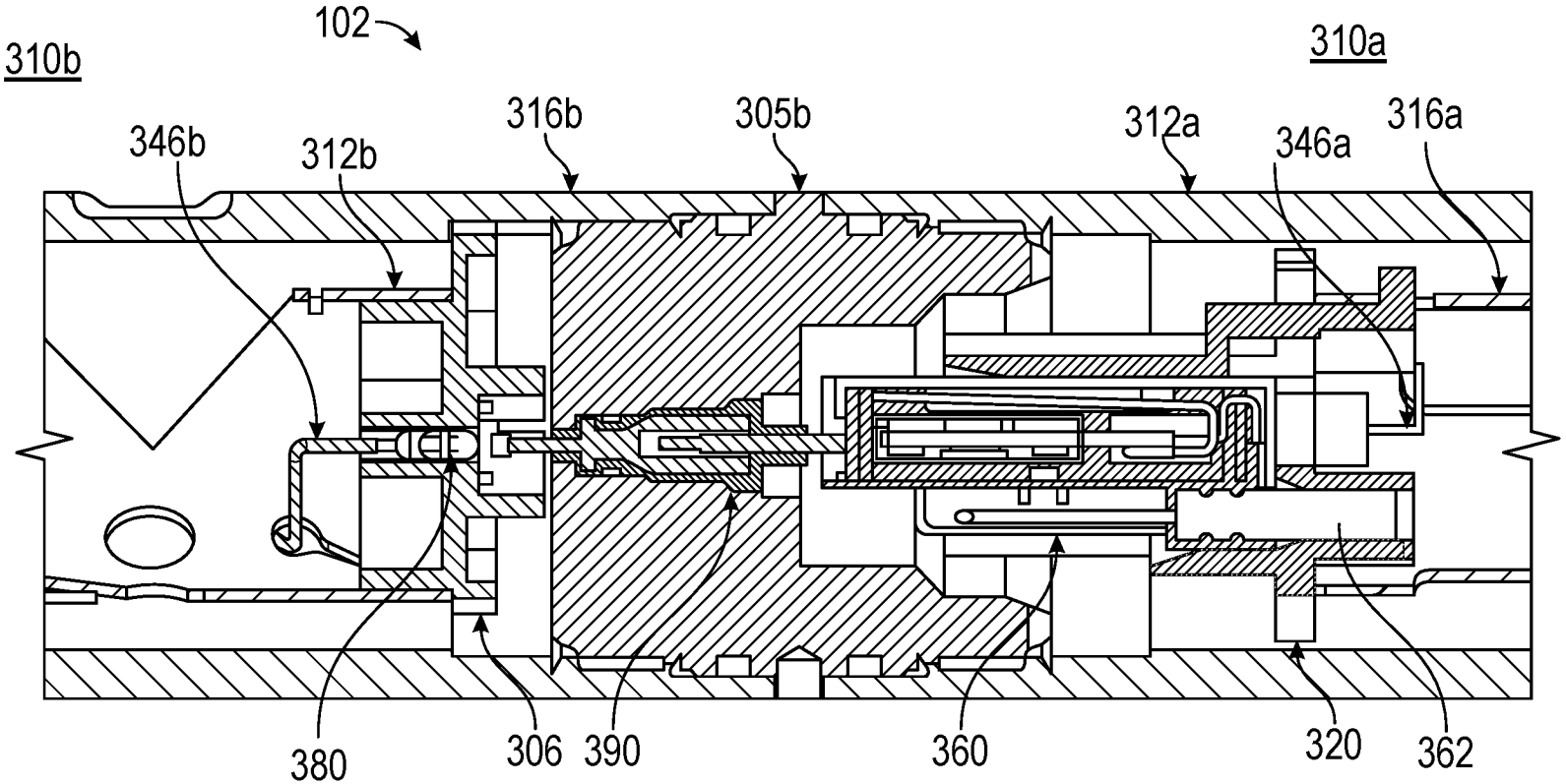
FIG. 3C is an enlarged section showing the connection between two perforating guns of FIG. 3B, in accordance with some examples of the present disclosure.

FIG. 3C is a close-up view of the section of FIG. 3B where the two perforating guns 310*a* and 310*b* are coupled together. As shown, the first gun body 316*a* is coupled to the second gun body 316*b* by a bulkhead 305*a* and an end alignment 390 of the second gun 310*b*. Also visible is the detonator housing 320 of the first perforating gun 310*a* housing a detonator 360, and an electrical contact 380 which electrically couples the two guns through an electrical feedthrough 306 of the bulkhead 305*a*, to be discussed later in detail. In operation, an electrical signal traveling through wire 346*a* of the first perforating gun 310*a* passes to the detonator assembly and explosive initiator 362 seated within the detonator housing 320 and ignites a detonating cord to trigger detonation of the first perforating gun 310*a*. As alluded to previously, the detonation signal then passes through an electrical feedthrough 306 of the bulkhead 305*b* of the second perforating gun 310*b* from where it enters an electrical contact 380, passes through an electrical feedthrough of an end alignment 390, and enters the next perforating gun 310*b* of the perforating tool assembly 102. As mentioned previously, some perforating guns may experience detonation failure issues. To that end, an electrical contact 380 is provided in FIG. 4A which may address at least in part this issue.

Figure 4A:
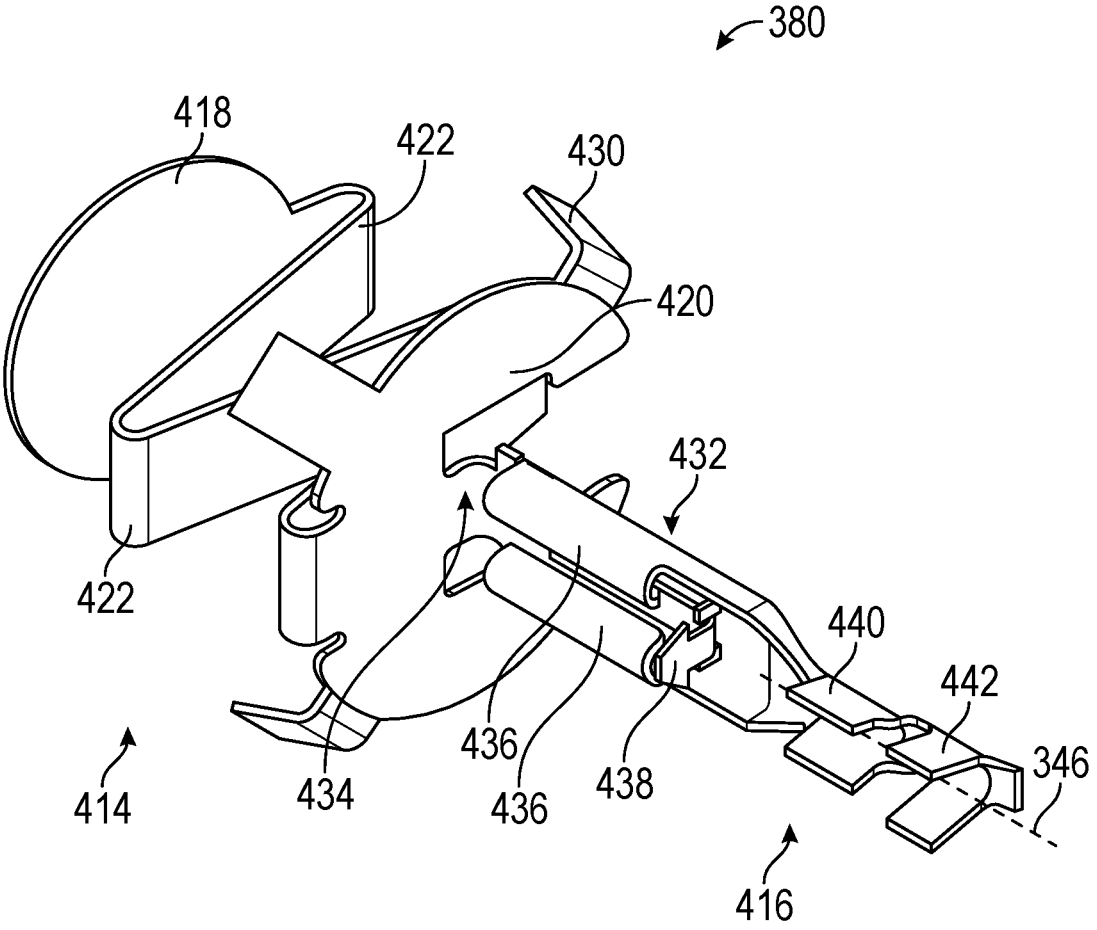
FIG. 4A is an isometric view of the electrical contact, in accordance with some examples of the present disclosure.

FIG. 4A is an isometric view of the electrical contact 380. As mentioned, the electrical contact 380 provides improved, more reliable electrical connection between perforating guns, such as between the first perforating gun 310*a* and the second perforating gun 310*b* (e.g., referring to FIG. 3B). The electrical contact 380 of the present disclosure specifically allows for improvements related to the prevention of electrical contact failures, e.g., open circuit failures, between the electrical contact and the contact pin. Technical improvements include, without limitation, improved spring force needed to counteract the deformation caused by the contact pin. The addition of multiple (e.g., three, four, five, six, or more) bends 422 after the contact plate 418 keeps the contact plate 418 axially located during deformation from contact with the contact pin. The addition of fins 430 and a support plate 420 allow for centralization of the electrical connector 414 after assembly, as well as add retention by means of interference with housing, creating a stable anchor point for the electrical assembly.

As illustrated, the electrical contact 380 generally comprises an electrical connector 414 and a wire connector 416. The electrical connector 414 and wire connector 416 may comprise two separate pieces or may unitarily form a single piece. For ease of manufacturing, however, it may be desirable for the electrical contact 380 to comprise two separate pieces, which are joined together at a mated connection 432. Alternatively, the two separate pieces may be welded, soldered, crimped, or joined in any suitable manner such that electrical connector 414 and wire connector 416 have a reliable electrical connection.

An example configuration of the electrical connector 414 is that it comprises a contact plate 418 on the upper end, i.e., uphole end, followed by multiple bends 422 leading to another support plate 420 on the lower end with exterior fins 430 that provide stability to that part as well as retention when installed after a wire connector 416 of the electrical contact 380 that accepts the mating end 434. The support plate 420 may also have multiple bends which may aid in the ability to maintain axial contact with the end of the contact pin while providing sufficient spring force to counteract deformation caused by the pin. The support plate 420 also may comprise fins 430 which may further provide centralization, retention, and stability as an anchor point. Specifically, an inner diameter of the end alignment 390 (e.g., referring to FIG. 5A, 5G) where the electrical connector 414 may be undersized in a way such that the tabs 530 bite into the inner diameter so as to provide stability. Also, once assembled, the fins 430 may allow contact between electrical connector 414 and the inner diameter of the end alignment 390 such that the electrical connector 414 experiences a resistive force, thereby centralizing it. A mating end 434 may axially extend from the support plate 420.

An example configuration of the mated connection 432 (e.g., wire connector) is that it comprises one or more mating slots 436 and a stop 438. In this way, the mating end 434 of the electrical connector 414 may be inserted into the one or more mating slots 436 until it reaches the stop 438. In some examples, the mated connection 432 may comprise or be accompanied by one or more crimped connections, such as by crimping the one or more mating slots 436 on the mating end 434 of the electrical connector 414. Use in this manner may ensure a good, reliable connection between a wire 346 and the electrical contact 380, and therefore by extension, between a first perforating gun 310*a* and a second perforating gun 310*b* of a gun string (e.g., referring to FIG. 3B).

One or more crimped connections may additionally be used to electrically couple wire 346 to the wire connector 416. As illustrated, the wire connector may, in some examples, comprise two wire crimping sections 440, 442. As illustrated, the two wire crimping sections 440 and 442 may be vertically displaced from each other relative to a longitudinal axis of the mating end 434 of the electrical connector 414. Use in this manner may, in some examples, allow for more secure fastening of the wire 346 to the wire connector 416.

Figure 4B:
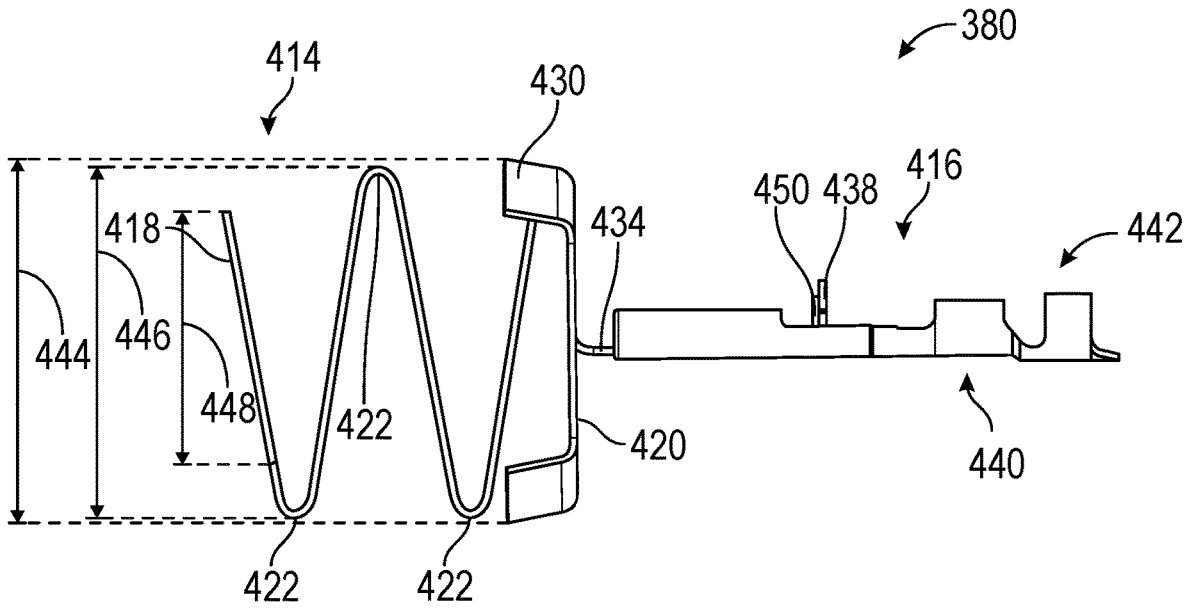
FIG. 4B is a side view of the electrical contact, in accordance with some examples of the present disclosure.

FIG. 4B is a side view of the electrical contact 380. As illustrated, the 2D bend-to-bend distance 446, i.e., "two-dimensional linear dimension of the bends," of the electrical contact 380 may be approximately equal to or less than the diameter of the periphery 444 formed by the external fins 430, but greater than the 2D distance 448 of the contact plate 418. As used herein, "approximately equal to" in this contact refers to a margin of +/−5%. This ensures that the fins 430 properly limit side-to-side mobility of the electrical contact 380, i.e., relative to the central axis of the electrical contact 380, when disposed within the end alignment 390 (e.g., referring to FIG. 5A, 5G). The number of bends 422 may vary, however, may be three or more, such as four in the illustrated example. Alternatively, five, six, seven, etc. A high number of bends ensures that prolonged contact with the contact pin limits the amount of permanent (inelastic) deformation undergone by the electrical contact 380. While a small, expected amount of inelastic deformation is inevitable as the natural result of engaging the contact pin for any amount of time, the disclosed designs having the high number of bends increases the amount of stress and/or strain that would be required to disrupt the electrical contact's 414 ability to properly and reliable engage the contact pin. In other words, designing the electrical contact 380 with more bends 422 increases its longevity and reliability despite prolonged compression by the contact pin, such as that applied during transport, assembly, or any prolonged amount of time that the contact pin is engaged prior to detonation.

As illustrated, the protrusion 450 of the mating end 434 of the electrical connector 414 may seat against the stop 438 of the wire connector 416. This particular arrangement may, in some examples, ensure that the mating end 523 is inserted at the correct insertion distance in the mating slot(s) 436 (e.g., referring to FIG. 4A) of the wire connector 416. Also visible in this figure is how the vertically displaced end 442 of the wire connector 416 may be situated below the in-line crimping section 440, for example, by at least 1 millimeter, at least 4 millimeters, or at least 10 millimeters below the in-line crimping section 440. As mentioned, this may allow in some examples more secure fastening of the wire 346 to the wire connector 416 as well as reduced likelihood of frictional wear or undue stress experienced by the wire 346.

Figure 4C:
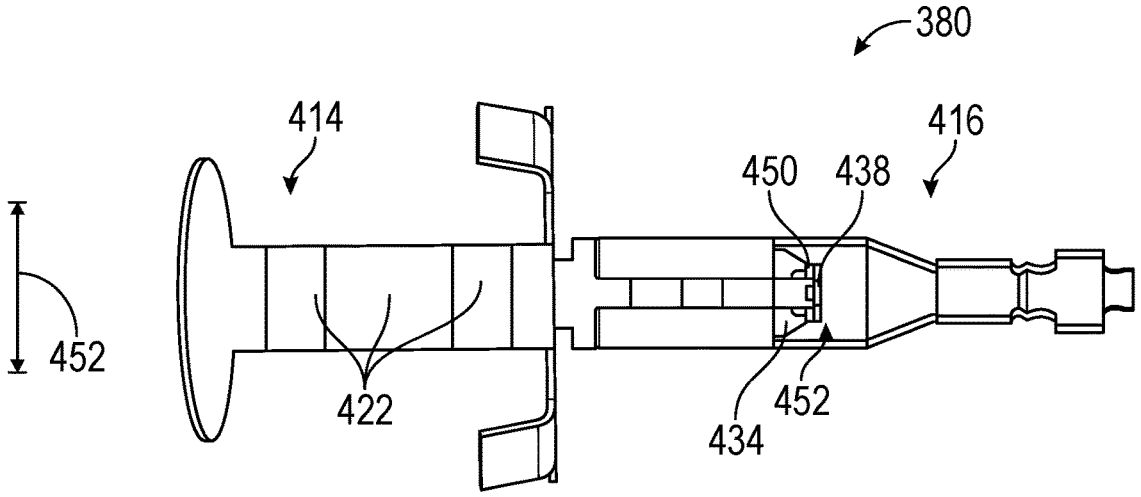
FIG. 4C is a side view of the electrical contact, in accordance with some examples of the present disclosure.

FIG. 4C is a side view of the electrical contact 380 of FIG. 4B rotated by 90 degrees, in accordance with one or more examples of the present disclosure. As illustrated, the portion of the electrical connector 414 with the bends 422 may be substantially similar in width 452 to the body of the wire connector 416. Alternatively, the width 452 may be narrower or wider than the wire connector 416. The magnitude of the width 452 may vary inversely with the required number of bends 422 needed to provide a reliable electrical connection. For example, a larger width 452 may require a smaller number of bends 422 while a narrower width 452 may require more. Also visible in this figure is the protrusion 450 of the mating end 434 of the electrical connector 414 seated against the stop 438, as seen in FIG. 4B, as well as one exemplary configuration of a lock receptacle of the wire connector 416 with which the mating end 434 of the electrical connector 414 may be engaged.

Figure 4D:
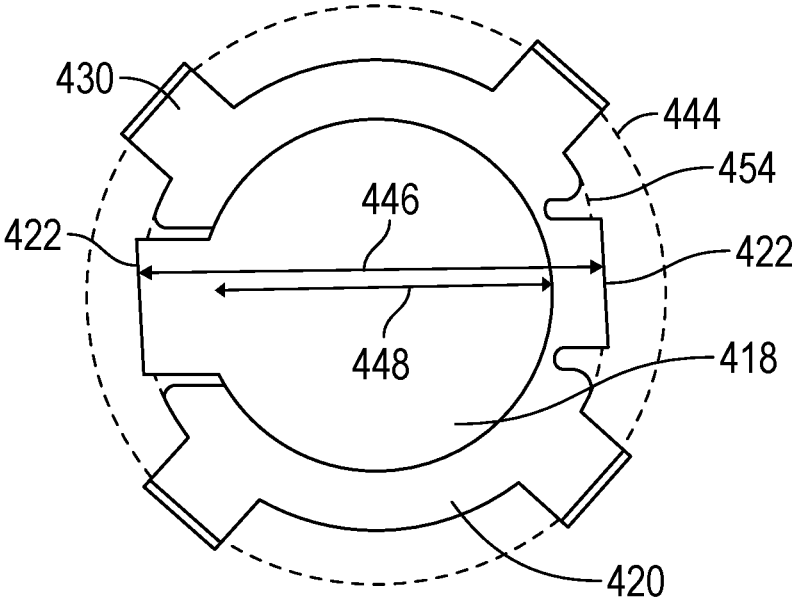
FIG. 4D is downhole view of the electrical contact, in accordance with some examples of the present disclosure.

FIG. 4D is a downhole view of the electrical contact 380 in accordance with one or more embodiments. As illustrated, the 2D distance 446 spanned by the bends 422 may, in some examples, surpass the outer diameter of the support plate 420 without the fins 430, represented by periphery 454. Alternatively, the 2D distance 446 may be less than the diameter of the periphery 444, as previously mentioned. Also visible is how the contact plate 418 may have a smaller circumference than the outer diameter 454 of the support plate 420, however, the contact plate 418 may have a circumference up to or surpassing the outer diameter of the support plate 420. Also visible in this figure is the 2D linear distance 448 formed by the contact plate 418, which may be less than the two dimensional linear distance 446 of the bends 422.

Figure 4E:
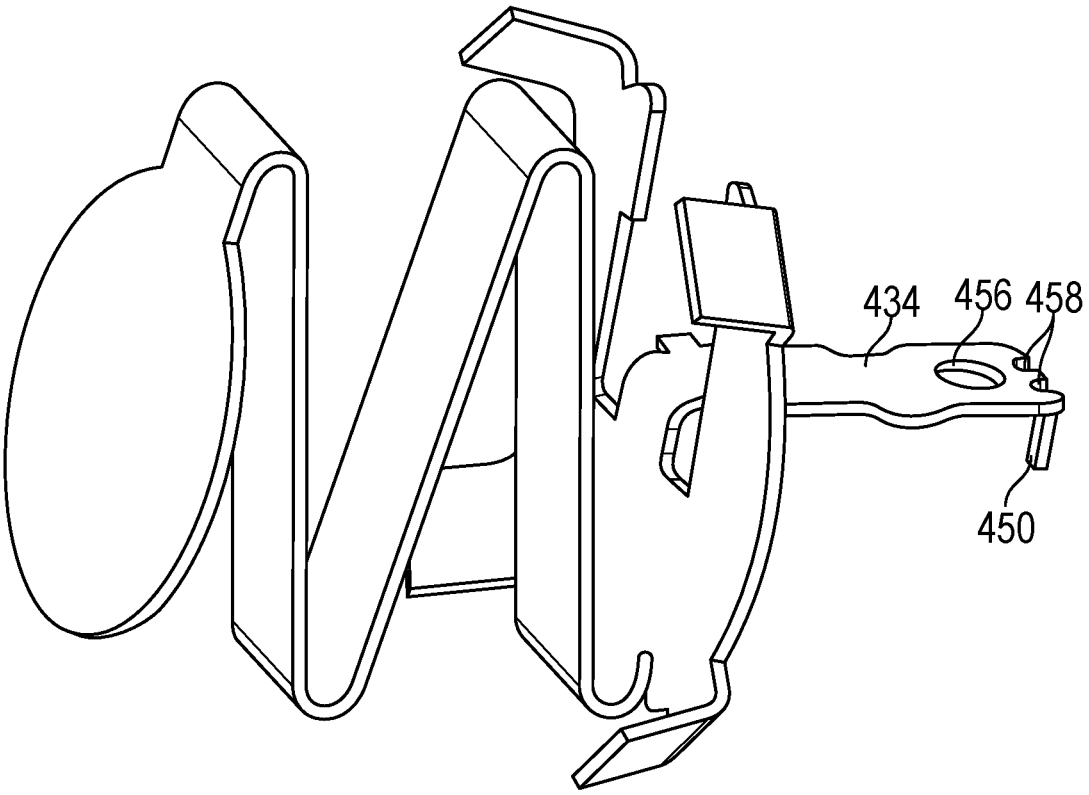
FIG. 4E is a schematic illustration of the electrical contact with the wire connector omitted for reference, in accordance with some examples of the present disclosure.

FIG. 4E is a perspective side view of electrical contact 380 with the wire connector 416 omitted for reference to show the mating end 434, in accordance with one or more embodiments. The electrical connector 414 in this figure is flipped upside-down with reference to FIG. 4C to show the mating end 434 of the mated connection 432 (e.g., referring to FIG. 4A). Also visible is a hole 556, as well as a protrusion 450 and one or more divots 458 of the mating end 434, according to some examples. The divots 458 may be used with a positive lock receptacle of the wire connector 416.

Figure 5A:
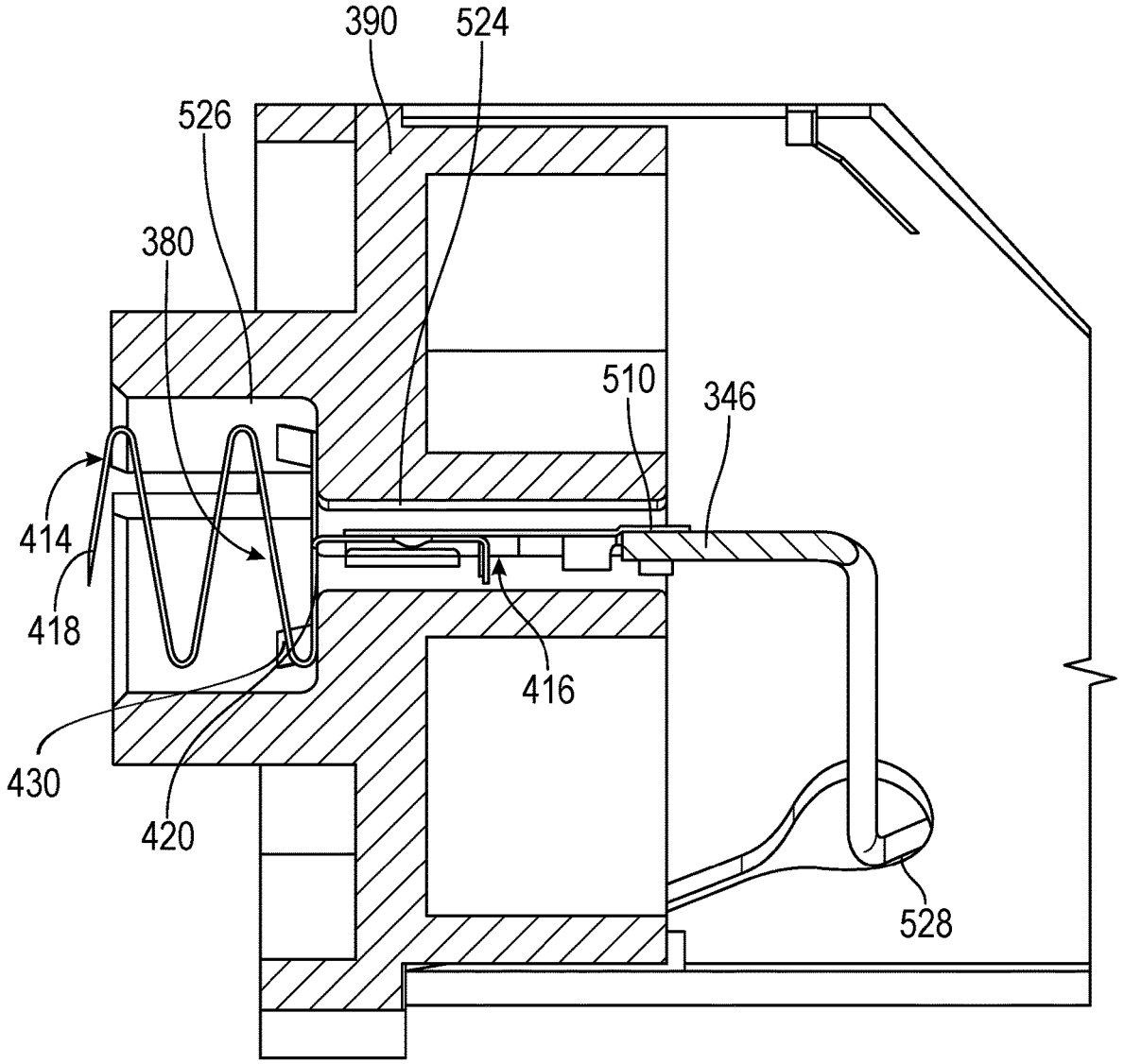
FIG. 5A is a cross-sectional, enlarged side view of the perforating gun at the end alignment, with the contact pin omitted for reference to show the electrical contact in an uncompressed state, in accordance with some examples of the present disclosure.

FIG. 5A is a close-up view of the interface between the end alignment 390 and the charge tube 312, which shows the electrical contact 380 in an uncompressed state. As shown, wire 346 may be electrically coupled to electrical contact 380 via, for example, one or more crimped connections 510. Alternatively, by any suitable wire connection. The crimped portion of the wire may or may not be insulated, so long as the wire 346 has sufficient contact area with a conductive portion of the electrical contact 380 so as to successfully transmit an electrical signal to the contact plate 418 when it is compressed against the contact pin. As illustrated, at least a portion of the wire connector 416 and/or electrical connector 414, or more generally, electrical contact 380, passes through one or more internal regions of the end alignment 390, such as through a passageway of a first region 524 and a passageway through a second region 526 characterized by a first (smaller) and second (larger) inner diameter respectively, as illustrated. Use in this manner may serve to both minimize the amount of space occupied by the electrical contact 380 as well as ensure that the electrical contact 380 is oriented properly with respect to the contact pin and within the one or more internal regions of the end alignment 390. Also visible are the fins 430 of the support plate 420 which serve to centralize the electrical contact 380 within the second passageway 526 of the end alignment 390 and prevent improper alignment of the electrical contact 380 relative to the contact pin. Specifically, the fins 430 may prevent differential and/or vertical (i.e., relative to a central axis of the first passageway 524 of the end alignment 390) drift of the electrical contact 380 during and/or after tubular make-up of the gun string, to be discussed in more detail in later figures. Also visible is an opening 528 through which the wire 346 may pass through in some examples to provide electrical communication between signal conductors of neighboring perforating guns (e.g., wire 346*a* and wire 346*b* of FIG. 3C), via the electrical contact 380.

Figure 5B:
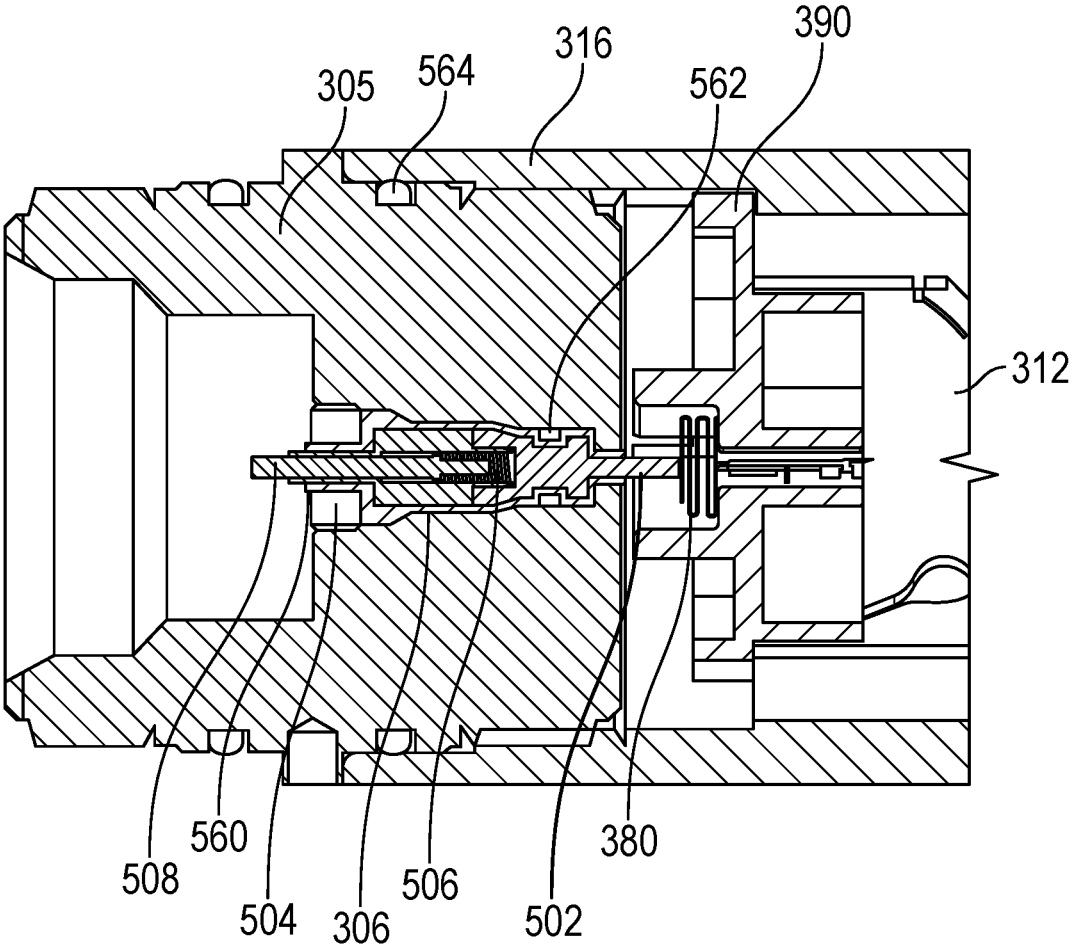
FIG. 5B is a cross-sectional, enlarged side view of the perforating gun at the bulkhead, which shows the electrical contact in a compressed state against a contact pin, in accordance with some examples of the present disclosure.

FIG. 5B is a close-up view of the interface between the bulkhead 305 and the end alignment 390. As illustrated, the electrical contact 380 is disposed in a through passageway of the end alignment 390. In the illustrated embodiment, the electrical contact 380 is in a compressed state while contacting the contact pin 502 that extends from the electrical feedthrough 306 of the bulkhead 305. In operation, an electric signal is passed (e.g., left to right) from an uphole perforating gun (e.g., perforating gun 310*a* on FIG. 3B) through the electrical feedthrough 306 portion of the bulkhead 305 to the contact pin 502 to the electrical contact 380 to a wire (not shown), from where it passes downhole to a detonator located on another end of the perforating gun (e.g., detonator 360*b* of perforating gun 310*b* shown on FIG. 3B). This way, the detonation signal may proceed downhole in a down-going fashion, as previously mentioned.

The contact pin 502 may be held in place by any suitable mechanism. For example, retaining nut(s) 504 are shown that serve to ensure that the contact pin is centralized within the electrical feedthrough 306 of the bulkhead 305. As illustrated, contact pin 502 extends from a receptable 560 formed in the first end of the bulkhead 305 through the electrical feedthrough 306 and to a second end of the bulkhead 305 into the end alignment 390. The receptable 560 of the bulkhead 305 may be threaded. The contact pin 502 may comprise, for example, a sliding mandrel 508 and a spring 506 which ensures good and reliable electrical connection with the detonator assembly upon tubular make-up of the gun string (e.g., again referring to FIGS. 3A-3C). Other locking features, such as the internal O-ring 562, may further ensure good centralization of the contact pin to ensure a reliable electric connection with the electrical contact 380. The O-rings 562 may provide internal sealing between upper and lower sections of a bore of bulkhead and a feedthrough pin insert. The positioning of the electrical contact 380 relative to the end alignment 390 and contact pin 502 is carefully controlled by various features of the electrical contact 380 during contact with the contact pin. Also visible is the charge tube 312 seated against the end alignment 390. Also shown in this figure are O-rings 564 disposed on an exterior of the bulkhead 305 that may be used to sealingly engage the bulkhead 305 with the perforating gun body 316

Alternate embodiments of the electrical contact 380 are also possible, for example, wherein the bends 422 are not identical (e.g., not having the same 2D distance 446, referring to FIGS. 4B, 4D); wherein the bends 422 span a different amount of distance than the periphery 444 and/or diameter 454 of the support plate 420 (e.g., referring to FIG. 4D); wherein the electrical contact 380 is made up of one single part or greater than two parts; wherein the electrical contact 380 has less than or greater than four fins on the support plate 420; wherein the fins are located somewhere other than the support plate 420 (e.g., the contact plate 418); wherein there are more than two plates 418, 420; wherein materials can be any electrically conductive material (e.g., carbon fiber(s)); and any combination of the foregoing.

Also shown by the figure is how at least a portion of the end alignment 390 may be seated within the charge tube 312. One purpose (among many) of the end alignment is to centralize the charge tube 312 within the gun body 316 such that the charge tube 312 and the gun body 316 do not touch. For example, the end alignment 390, which may be made of an electric insulating material (e.g., plastic) may physically and/or electrically separate the charge tube 312 from the gun body 316 such that the charge tube 312 is sheltered from the surrounding environment (e.g., the wellbore 110 of FIG. 1) of the perforating gun assembly (e.g., referring to FIG. 1). To that end, FIGS. 6A-6H show an end alignment 390 in more detail.

Figure 6A:
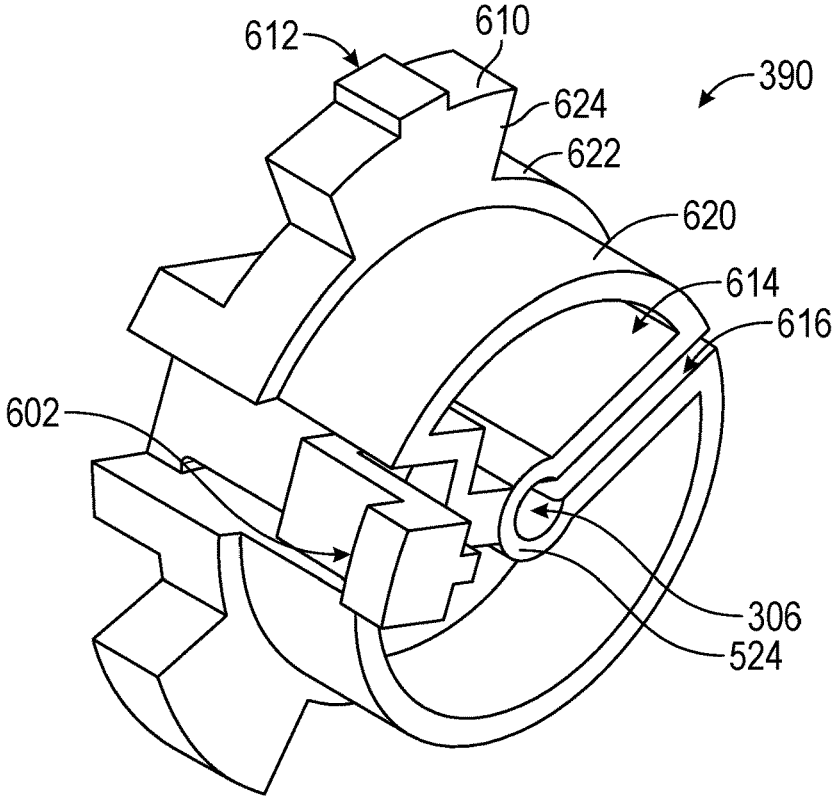
FIG. 6A is an isometric view of the end alignment, in accordance with some examples of the present disclosure.
Figure 6B:
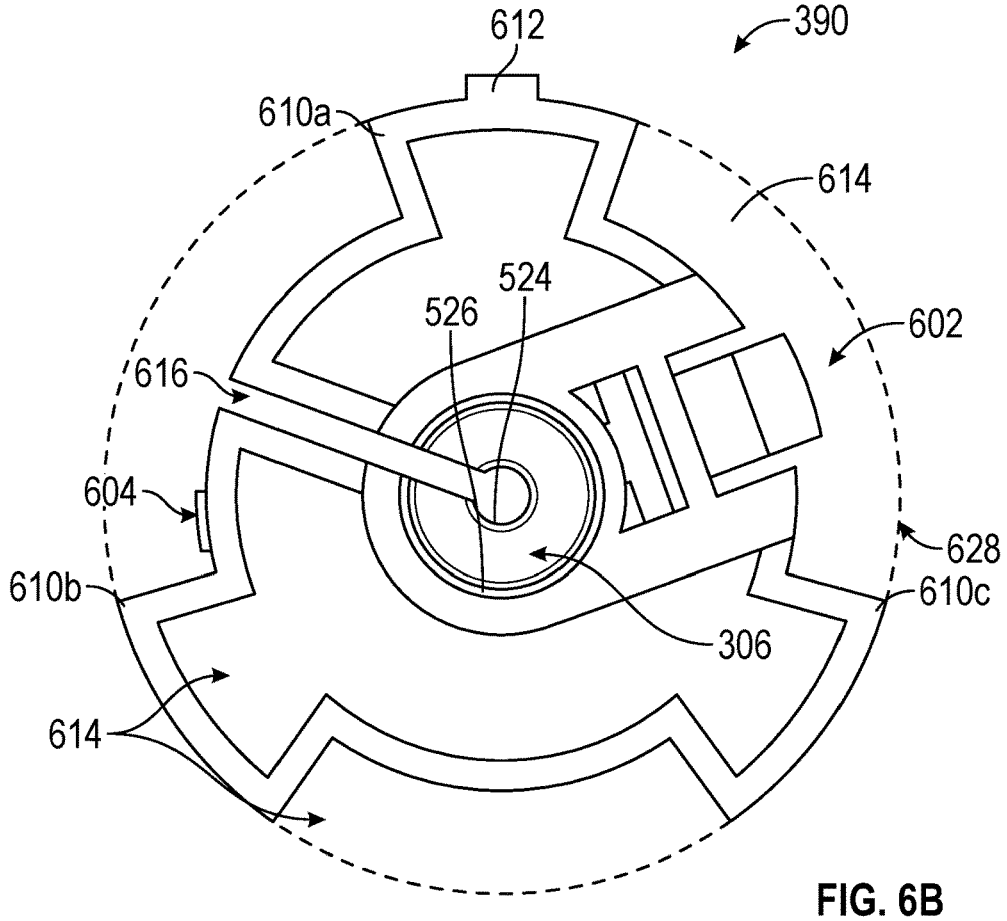
FIG. 6B is a downhole view of the end alignment, in accordance with some examples of the present disclosure.

FIG. 6A is an isometric view of the end alignment 390 with the electrical contact 380 and wire 346 omitted for reference, in accordance with one or more embodiments of the present disclosure. FIG. 6B is a downhole view of the end alignment 390 with the electrical contact 380 and wire 346 also omitted for reference, in accordance with one or more embodiments of the present disclosure. FIGS. 6A and 6B both show the stand-alone end alignment 390 without any of the other gun components which would typically be connected to it to form the perforating gun 310 (e.g., referring to FIG. 3A).

As shown and described in previous figures, the perforating gun 310 comprises an end alignment 390. The end alignment 390 is a multipurpose device which, among other things, provides a secure space, through which the electrical detonation signal passes safely and unhindered by external influences (e.g., detonation, wellbore 110 of FIG. 1, etc.) to the electrical feedthrough 306 of the bulkhead 305. As discussed previously, the one or more internal regions, i.e., regions 524, 526, referring to FIG. 5A, of the end alignment 390 also allow the electrical contact 380 to be stably and centrally positioned to ensure good electrical contact with the contact pin.

The end alignment 390 may be unitarily formed as one piece, such as by injection molding, additive manufacturing (i.e., 3D printing), or the like. Alternatively, one or more components of the end alignment 390 (e.g., including the collet 602 and lug 604) may be separately attached to the end alignment 390, such as but not limited to over molding, fastening, snap fitting, or other methods of joining. The end alignment 390 may comprise any suitable electrically insulating material, such as plastic, provided that it has sufficient strength to resist breaking.

A periphery 628 of the end alignment 390 may define an outer diameter of end alignment 390. The periphery 628 may include a plurality of non-contiguous peripheral portions, e.g., ears 610*a*, 610*b*, 610*c*, etc., circumferentially spaced along a generally circular profile indicated by a dashed line at 628 that may conform to an inner diameter of a charge tube or other outer perforating gun component (e.g., gun body 316 of FIG. 3A).

As previously mentioned, the skeletonized body of the end alignment 390, i.e., having one or more significant portions removed as cut-outs 614, aids in material reduction while not significantly compromising integrity or functionality of the end alignment 390. This functionally limits the amount of material used, resulting in a smaller footprint, as well as the total cost (e.g., by as much as 30%) of the piece than what would otherwise be achieved without the skeletonizing of the end alignment 390. As illustrated, cut-outs 614 are also formed between ears 610*a*, 610*b*, 610*c*, etc., to reduce the amount of space occupied by the end alignment 390.

Also visible in FIGS. 6A and 6B is the wire routing slot 616, which allows for ergonomic placement of the wire 346 to the electrical contact 380 and/or placement of the electrical contact 380 and wire 346 to its appropriate position within the end alignment 390 during assembly.

As illustrated, the end alignment 390 may comprise a collet 602 and lug 604. The collet 602 and lug 604 may provide an ergonomic way to assemble which may, in some examples, not rely on external screws or fasteners that add time, additional cost, and difficulty of assembly. Specifically, the collet 602 and lug 604 facilitate assembly by allowing, for example, a single acceptable radial orientation of the end alignment 390 relative to a central axis of the charge tube 312 and/or perforating gun 310.

During assembly, the narrow portion 620 of the outer tubular body of the end alignment 390 is inserted into the charge tube 312 (e.g., referring to FIGS. 3A-3C, 5B) such that the collet 602 mates with (e.g., snaps into) an opening of the charge tube 312 and the lug 604 slides into another opening, e.g., a j-slot (to be shown and discussed in later figures), of the charge tube 312. At the interface between narrow portion 620 and wider portion 622 of the outer tubular body is a contact surface 624 which seats against the charge tube 312. In other words, the narrow portion 620 slides into the charge tube 312 until the charge tube 312 is stopped by the contact surface 624, at which point, the collet 602 and opening 608 are properly engaged.

All the disclosed methods of joining are an integral part in the design, however, while only a few specific configurations are shown, it should be understood that the scope of the present disclosure is intended to encompass any combination of the various features herein described. Alternative or additional fastening methods to the collet 602 and lug 604 may comprise, for example, interference fits, press fits, snap fit designs, living hinges, twist lock designs, transition fits, combinations thereof, and the like. In an alternative example, lug 604 may instead comprise more than one lug, e.g., a double lug. For example, two lugs may be spaced as a pair of lugs proximate the other. Alternatively, a first lug may be disposed on one circumferential location of the end alignment 390 and a second lug disposed on another circumferential location of the end alignment. Use in this manner may, in some examples, provide yet additional differential stability to the end alignment 390 and/or the one or more gun components attached thereto.

Figure 6C:
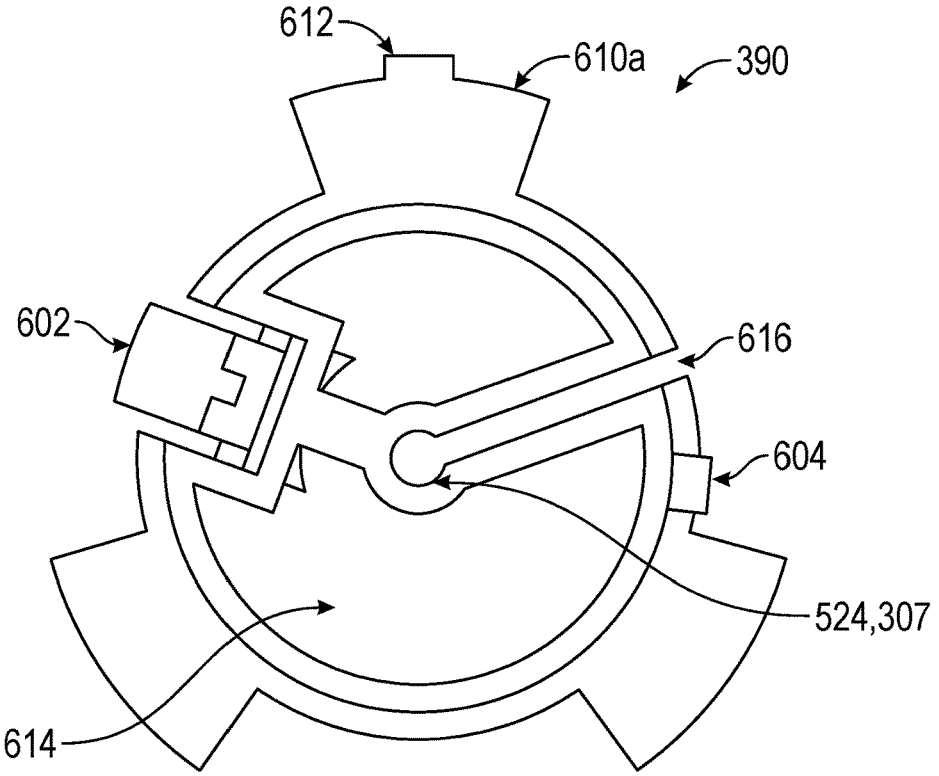
FIG. 6C is a view of the end alignment, in accordance with some examples of the present disclosure.

FIG. 6C is view of the end alignment 390 with the electrical contact 380 and wire 346 omitted for reference. FIG. 6C is identical to FIG. 6B, only that it is flipped around. As illustrated, at least part or the whole of the region indicated by cut-out 614 may be removed to reduce the amount of material needed for the manufacture of the end alignment 390. Also visible is the comparatively small inner diameter of the narrower region 524 of the electrical contact passthrough 307 of the end alignment 390. Also shown is the collet 602, lug 604, mating notch 612 atop ear 610*a*, and wire routing slot 616.

Figure 6D:
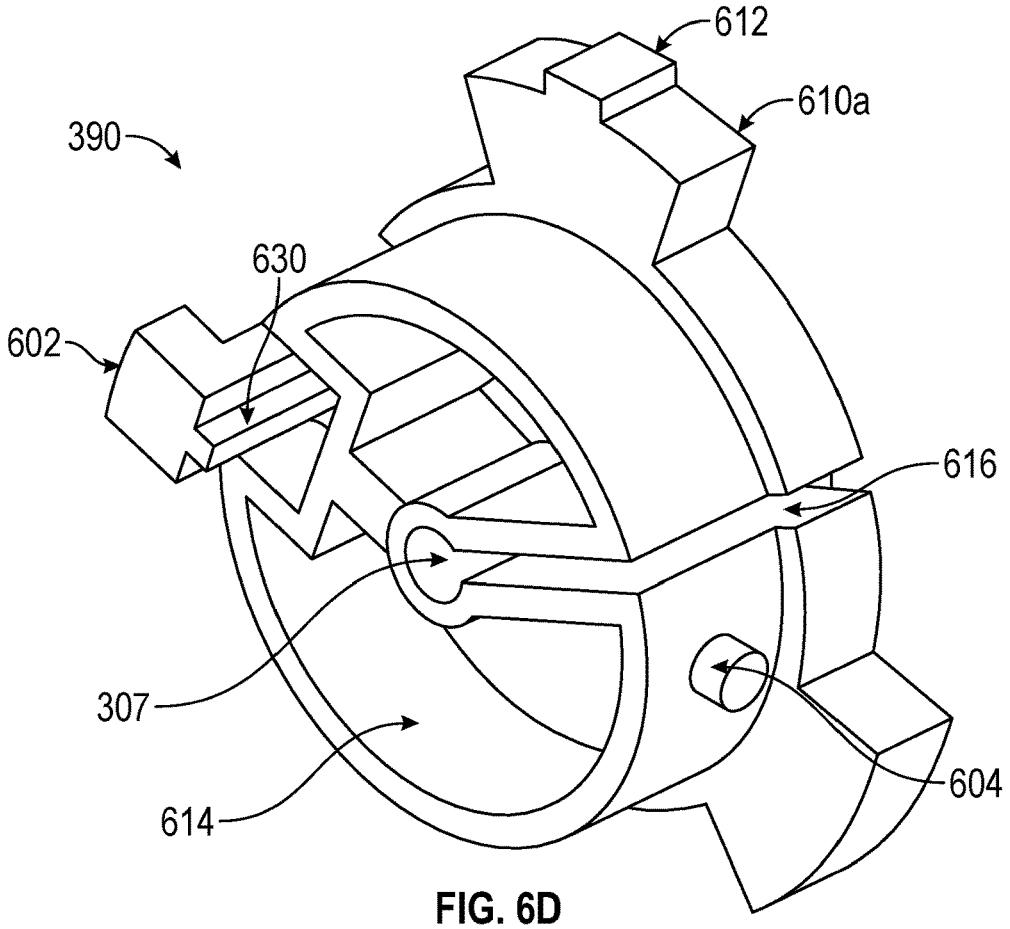
FIG. 6D is an isometric view of the end alignment, rotated by 90 degrees relative to FIG. 6A, in accordance with some examples of the present disclosure.

FIG. 6D is an isometric view of the end alignment 390 with the electrical contact 380 and wire 346 omitted for reference. FIG. 6D is identical to FIG. 6A, except that it is viewed as rotated by 90 degrees clockwise. As illustrated, the lug 604 is disposed on the side of the end alignment 390 substantially opposite the collet 602, however, may be placed at any circumferential location of the narrow portion 620 of the end alignment 390. Also visible is the wire routing slot 616, lug 604, electrical contact passthrough 307, collet 602, ear 610*a*, and mating notch 612. Visible in this view is a ridge 630 on the backside of the collet 602. Where used, ridge 630 may add rigidity to the collet and reduce stress concentration so that the collet does not break as easily as it might otherwise.

As mentioned previously, during assembly, the narrow portion 620 of the outer tubular body of the end alignment 390 is inserted into the charge tube 312 until the charge tube 312 is met by the contact surface 624 at the appropriate insertion distance. However, it is contemplated that an alternative configuration could be to have the narrow portion 620 be wider than the charge tube 312 so that the charge tube 312 instead inserts into the end alignment with the collet 602 flipped and the lug 604 disposed on an inner diameter of the outer tubular body of the end alignment 390 rather than on the outer diameter as illustrated. In such an embodiment, the narrow portion 620 (now modified to be the larger portion) of the outer tubular body of the end alignment 390 would fit around an outer surface of the charge tube 312, and the wider portion 622 (now the narrower portion) comprising the ears 610 would still function as the "stop," i.e., contact surface 624, to limit over-insertion.

Figure 6E:
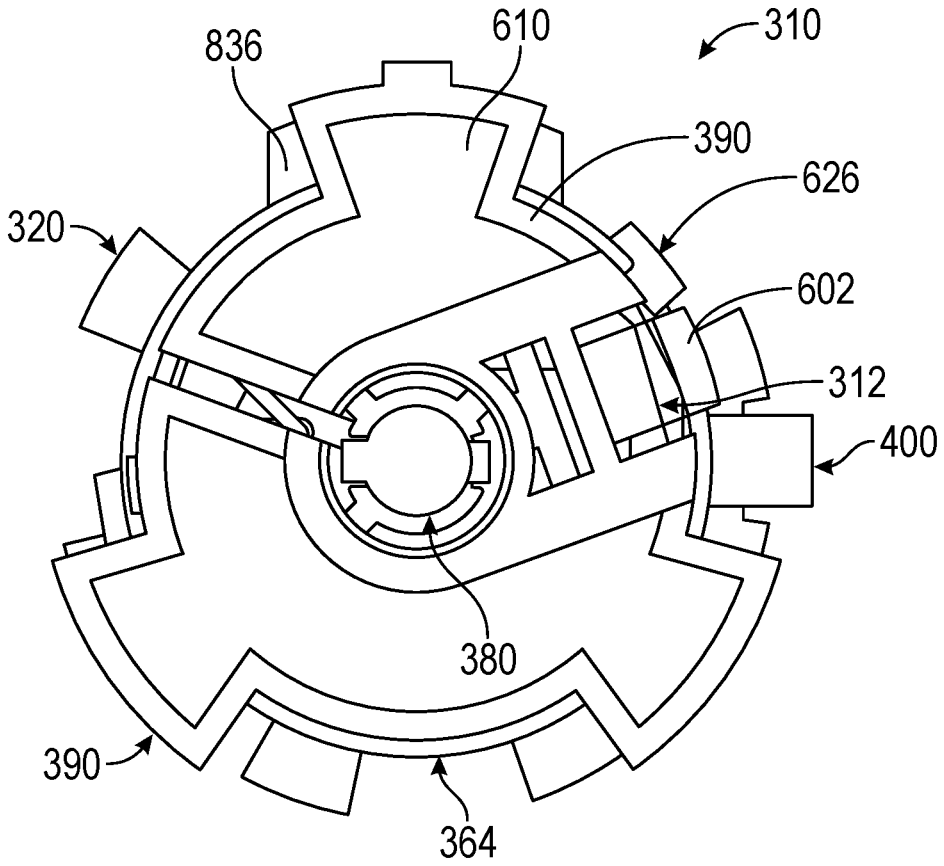
FIG. 6E is a downhole view of the perforating gun from the end alignment, in accordance with some examples of the present disclosure.

FIG. 6E is a downhole view of the end alignment 390 coupled to a charge tube 312 which is coupled to a detonator housing 320. FIG. 6E is substantially similar to FIG. 6B, except that the grounding clip 400 is shown extending out from the detonator housing 320, the wire 364 is shown helically wrapped around the charge tube 312, the electrical contact 380 is shown disposed within the end alignment 390, the collet 602 is shown seated in its corresponding opening (e.g., opening 606 of FIG. 6F) of the charge tube 312, as well as the radial protrusions, i.e., ears 610 of the end alignment 390. Also shown is a wire clip 626 used to secure wire 364 within/to the detonator housing 390. However, the bulkhead 305 and contact pin, which would be seated on or near the end alignment 390, is still omitted for reference. As illustrated, the end alignment 390 is assembled such that it is uphole from the detonator housing 320 and charge tube 312. For example, while the detonator housing 320 appears to be directly behind the end alignment 390 in this view, the charge tube 312 is still disposed between the end alignment 390 and the detonator housing 320.

Figure 6F:
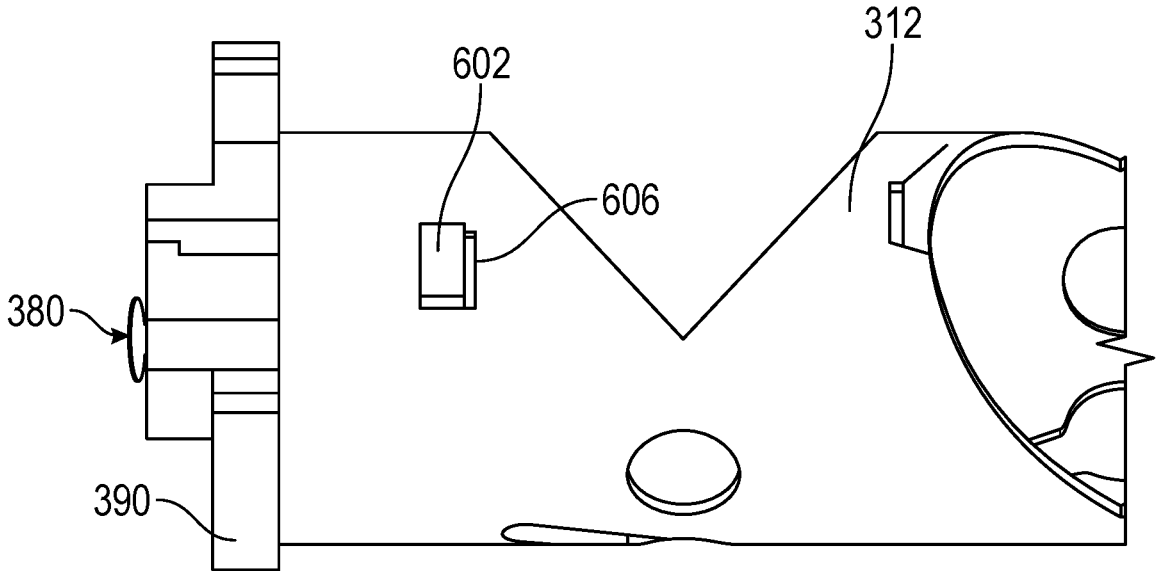
FIG. 6F is a side view of the interface between the end alignment and the charge tube to show a collet snapped into an opening, in accordance with some examples of the present disclosure.

FIG. 6F is a side view of the interface between the end alignment 390 and the charge tube 312. In the illustrated embodiment, the end alignment 390 and the charge tube 312 are interlocked. For example, the collet 602 of the end alignment 390 is snapped into the opening 606 of the charge tube 312. The openings 606, 608 (e.g., also referring to FIG. 6H) may be an aperture, slot (e.g., j-slot), or otherwise a materially formed receptacle or corresponding mating feature for interfacing with the collet 602 to interlock the end alignment 390 and the charge tube 312. Also easily discernible is the charge tube 312 seated against the end alignment 390, as well as how extend from the end alignment 390 is the electrical contact 380 in an uncompressed state. Upon attachment of the bulkhead 305 containing the contact pin with the end alignment 390, the electrical contact 380 would be compressed such that the bends and contact plate 418 of the electrical contact 380 are housed at least in part or entirely within the electrical contact passthrough 307 portion of the end alignment 390 (e.g., referring to FIG. 4A).

Figure 6G:
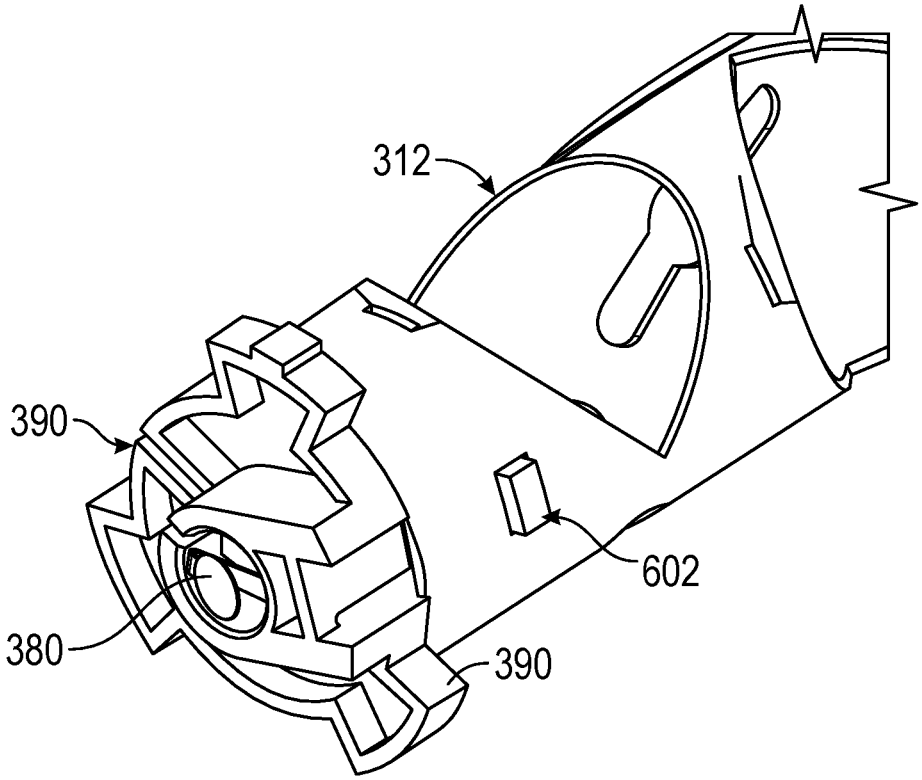
FIG. 6G is a perspective view of the end alignment and charge tube of FIG. 6F, in accordance with some examples of the present disclosure.

FIG. 6G is a perspective view of FIG. 6F, rotated counterclockwise 45 degrees. FIG. 6G likewise shows end alignment 390 interlocked with the charge tube 312. As illustrated, the collet 602 of the end alignment 390 may be snapped into the opening 606 of the charge tube 312 to interlock the end alignment 390 and the charge tube 312. Also shown are the cut-out sections of the end alignment 390 for skeletonizing of the end alignment 390.

Figure 6H:
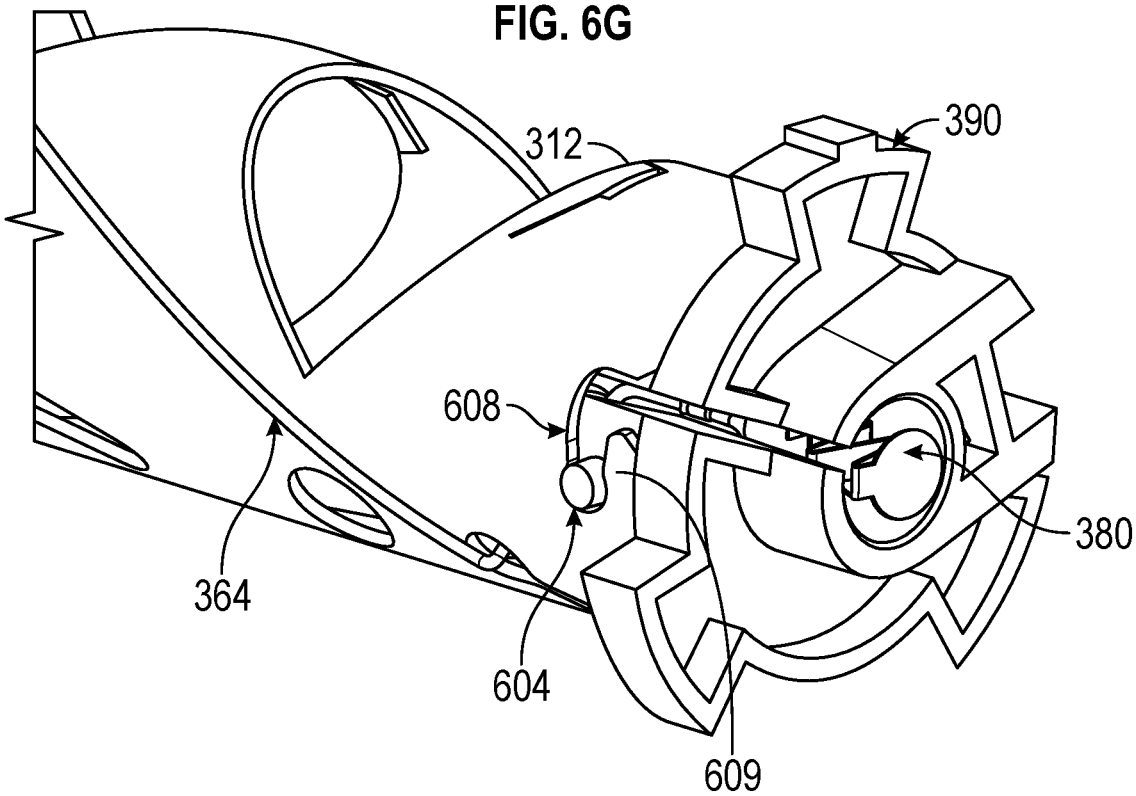
FIG. 6H is a perspective view of the end alignment and charge tube of FIG. 6G from the other side to show a lug seated in a j-slot, in accordance with some examples of the present disclosure.

FIG. 6H is a perspective view of FIG. 6F, rotated counterclockwise past 90 degrees. In this illustration, the lug 604 and opening 608 are visible, with the lug 604 fully seated in the opening 608 to interlock the end alignment 390 and the charge tube 312. In this example, opening 608 is a j-slot, having a non-linear profile to guide the lug 604 to its appropriate circumferential orientation relative to the charge tube 312. Also visible is a slight narrowing 609 of the opening 608 which may provide further resistance to counter rotation after assembly. As illustrated, the area of the slight narrowing 609 may be slightly narrower or approximately equal to the diameter of the lug 604, such that a small amount of force is required to fully seat the lug 604 past the slight narrowing 609 and into the opening 608. To fully engage the opening 608, the narrow portion 620 (e.g., referring to FIG. 6B) of the tubular body of the end alignment 390 is inserted into the charge tube 312 and rotated counterclockwise past the slight narrowing 609, at which point the collet 602 (e.g., referring to FIGS. 6F and 6G) is properly aligned. To uninstall the end alignment 390 from the charge tube 312 after assembly, a disassembler would, in some examples, manually push in the collet 602 and, while the collet 602 is in a depressed position relative to the opening 606, rotate the end alignment 390 clockwise to disengage the lug 604 from the opening 608. Use in this manner may allow the end alignment 390 to be releasably attached to the charge tube. It should be understood that while one specific configuration is illustrated in these figures, i.e., counter-clockwise engagement and clockwise disengagement of a j-slot with a collet at a specific location on the charge tube, other configurations are also possible, for example, clockwise engagement and counter-clockwise disengagement.

Likewise, it should be understood that the opening 608 and lug 604 may be located at various alternative circumferential position of the charge tube 312 to those shown by the figures. In some example configuration, the lug 604 itself may double as both the lug 604 and a collet 602, wherein the aperture is just past the end of the j-slot, and wherein the lug is configured (e.g., slanted or rounded) to slide into the aperture upon rotation of the end alignment 390 to its maximum stroke length. The end alignment 390 may also include various alternative features (e.g., double lug, dual collets, collet and lug combinations); various alternative electrical connections; various alternative detonator housing designs (e.g., different collet lengths, different methods of manufacturing, multi-part pieces, detonating cord stop feature of varying size, shape, location, number of protrusions); and collet 602 and lug 604 may be alternatively axially snapped into place, i.e., not twisted.

One or more aspects of the present disclosure may be used in various commercial gun systems to increase service quality and reliability of such systems and related products. These features may also be compatible with various third party equipment, may increase the likelihood for a reliable electrical connection downhole, maintain good service quality, and serve to maintain the reputation of established products while reducing non-productive time (NPT) at the work site. Also, as this design may in some examples not rely on additional fasteners, there may also be a potential cost reduction due to the removal of additional external fasteners which would ordinarily be required when designing a perforating gun.

Accordingly, the present disclosure may provide an electrical contact for a perforating gun and related apparatus, systems, and methods, which may have improved downhole reliability. The methods, systems, and tools may include any of the various features disclosed herein, including one or more of the following statements.

Statement 1: An electrical contact comprising: a contact plate; a support plate; and three or more bends disposed between the contact plate and the support plate to counteract a force applied to the contact plate when engaged by a contact pin, wherein the electrical contact is configured to convey a detonating signal through an electrical feedthrough extending through at least a bulkhead of two or more perforating guns.

Statement 2: The electrical contact of statement 1, further comprising two or more exterior fins for maintaining axial contact with the contact pin.

Statement 3: The electrical contact of statement 2, wherein the two or more exterior fins are disposed about the support plate, wherein an outer diameter of the support plate and the two or more exterior fins is greater than a two-dimensional linear dimension of the three or more bends.

Statement 4: The electrical contact of any of statements 1-3, wherein a two-dimensional linear dimension of the three or more bends is approximately equal to an outer diameter of the support plate not including exterior fins.

Statement 5: The electrical contact of any of statements 1-4, wherein the electrical contact is further configured to convey the detonating signal through an end alignment to a detonator via a mandrel and a spring.

Statement 6: The electrical contact of any of statements 1-5, wherein the electrical contact comprises an electrical connector and a wire connector, wherein the electrical connector and the wire connector are joined at a mating connection.

Statement 7: The electrical contact of statement 6, wherein the mating connection comprises one or more crimped connections.

Statement 8: The electrical contact of statement 6, wherein the mating connection comprises a mating end of the electrical connector inserted into a quick connect positive lock receptacle of the wire connector.

Statement 9: The electrical contact of statement 6, wherein a mating end of the electrical connector comprises one or more protrusions, and wherein the one or more protrusions are configured to contact a stop of the wire connector.

Statement 10: The electrical contact of any of statements 1-9, wherein the electrical contact consists of a single unitarily formed piece.

Statement 11: A method comprising: disposing two or more perforation guns into a wellbore extending into a subterranean formation, wherein the two or more perforation guns are electrically coupled by an electrical contact and a contact pin, the electrical contact comprising: a contact plate; a support plate; and three or more bends disposed between the contact plate and the support plate to counteract a force applied to the contact plate when engaged by the contact pin.

Statement 12: The method of statement 11, wherein the electrical contact further comprises two or more exterior fins for maintaining axial contact with the contact pin.

Statement 13: The method of statement 12, wherein the two or more exterior fins are disposed about the support plate, wherein a diameter of a circumferential profile formed by the two or more exterior fins is greater than a two-dimensional linear dimension of the three or more bends.

Statement 14: The method of any of statements 11-13, wherein a two-dimensional linear dimensions of the three or more bends is approximately equal to or less than a diameter of the support plate not including exterior fins.

Statement 15: The method of any of statements 11-14, further comprising passing a detonation signal through an electrical feedthrough extending through a bulkhead and an end alignment of at least one of the two or more perforating guns with at least the electrical contact, wherein the electrical contact is in electrical communication with the contact pin.

Statement 16: The method of any of statements 11-15, wherein the electrical contact comprises an electrical connector and a wire connector, wherein the electrical connector and the wire connector are joined at a mating connection.

Statement 17: The method of statement 16, wherein the mating connection comprises one or more crimped connections, and wherein the mating connection comprises a mating end of the electrical connector inserted into a quick connect positive lock receptacle of the wire connector.

Statement 18: The method of any of statements 11-17, wherein the contact pin comprises, or is attached to, a spring and a mandrel.

Statement 19: A method of assembling a perforating gun string, the method comprising: securing a plurality of perforating charges at different positions and firing orientations along a charge carrier; securing an end alignment between the charge carrier and a bulkhead, the end alignment and bulkhead comprising an electrical feedthrough; disposing an electrical contact within the electrical feedthrough, the electrical contact comprising a contact plate, a support plate, and three or more bends disposed between the contact plate and the support plate, and engaging the contact plate with a contact pin, wherein the electrical contact and the contact pin are configured to transmit a detonation signal between a first perforating gun and a second perforating gun for detonating the perforating gun string.

Statement 20: The method of statement 19, wherein the electrical contact further comprises two or more exterior fins disposed about the supporting plate or the contact plate.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An electrical contact comprising:

a contact plate;

a support plate;

three or more bends disposed between the contact plate and the support plate to counteract a force applied to the contact plate when engaged by a contact pin, wherein the electrical contact is configured to convey a detonating signal through an electrical feedthrough extending through at least a bulkhead of two or more perforating guns, wherein the three or more bends comprise three or more folds that do not extend past a diameter of the support plate to keep the contact plate axially located during deformation from contact with the contact pin; and two or more exterior fins for maintaining axial contact with the contact pin, wherein the two or more exterior fins are disposed about the support plate, wherein an outer diameter of the support plate and the two or more exterior fins is greater than a longitudinal distance between two folds.

2. The electrical contact of claim 1, wherein a longitudinal distance between two folds is approximately equal to an outer diameter of the support plate not including exterior fins.

3. The electrical contact of claim 1, wherein the electrical contact is further configured to convey the detonating signal through an end alignment to a detonator via a mandrel and a spring.

4. The electrical contact of claim 1, wherein the electrical contact comprises an electrical connector and a wire connector, wherein the electrical connector and the wire connector are joined at a mating connection.

5. The electrical contact of claim 4, wherein the mating connection comprises one or more crimped connections.

6. The electrical contact of claim 4, wherein the mating connection comprises a mating end of the electrical connector inserted into a lock receptacle of the wire connector.

7. The electrical contact of claim 4, wherein a mating end of the electrical connector comprises one or more protrusions, and wherein the one or more protrusions are configured to contact a stop of the wire connector.

8. The electrical contact of claim 1, wherein the electrical contact consists of a single unitarily formed piece.

9. A method comprising:

disposing two or more perforation guns into a wellbore extending into a subterranean formation, wherein the two or more perforation guns are electrically coupled by an electrical contact and a contact pin, the electrical contact comprising:

a contact plate;

a support plate;

three or more bends disposed between the contact plate and the support plate to counteract a force applied to the contact plate when engaged by the contact pin, wherein the three or more bends comprise three or more folds that do not extend past a diameter of the support plate to keep the contact plate axially located during deformation from contact with the contact pin; and two or more exterior fins for maintaining axial contact with the contact pin, wherein the two or more exterior fins are disposed about the support plate wherein an outer diameter of the support plate and the two or more exterior fins is greater than a longitudinal distance between two folds.

10. The method of claim 9, wherein the electrical contact further comprises two or more exterior fins for maintaining axial contact with the contact pin.

11. The method of claim 10, wherein the two or more exterior fins are disposed about the support plate, wherein a diameter of a circumferential profile formed by the two or more exterior fins is greater than a two-dimensional linear dimension of the three or more bends, wherein the two-dimensional linear dimension comprises a 2D bend-to-bend distance.

12. The method of claim 9, wherein a two-dimensional linear dimensions of the three or more bends is approximately equal to or less than a diameter of the support plate not including exterior fins.

13. The method of claim 9, further comprising passing a detonation signal through an electrical feedthrough extending through a bulkhead and an end alignment of at least one of the two or more perforating guns with at least the electrical contact, wherein the electrical contact is in electrical communication with the contact pin.

14. The method as in claim 9, wherein the electrical contact comprises an electrical connector and a wire connector, wherein the electrical connector and the wire connector are joined at a mating connection.

15. The method of claim 14, wherein the mating connection comprises one or more crimped connections, and wherein the mating connection comprises a mating end of the electrical connector inserted into a lock receptacle of the wire connector.

16. The method of claim 9, wherein the contact pin comprises, or is attached to, a spring and a mandrel.

17. A method of assembling a perforating gun string, the method comprising:

securing a plurality of perforating charges at different positions and firing orientations along a charge carrier;

securing an end alignment between the charge carrier and a bulkhead, the end alignment and bulkhead comprising an electrical feedthrough;

disposing an electrical contact within the electrical feedthrough, the electrical contact comprising a contact plate, a support plate, three or more bends disposed between the contact plate and the support plate, wherein the three or more bends comprise three or more folds that do not extend past a diameter of the support plate to keep the contact plate axially located during deformation from contact with the contact pin, and two or more exterior fins for maintaining axial contact with the contact pin, wherein the two or more exterior fins are disposed about the support plate, wherein an outer diameter of the support plate and the two or more exterior fins is greater than a longitudinal distance between two folds;

engaging the contact plate with a contact pin, wherein the electrical contact and the contact pin are configured to transmit a detonation signal between a first perforating gun and a second perforating gun for detonating the perforating gun string.

* * * * *